US010017709B2

(12) United States Patent
Sauer et al.

(10) Patent No.: US 10,017,709 B2
(45) **Date of Patent: *Jul. 10, 2018**

(54) MULTIPLE FUNCTION DISPERSANT VISCOSITY INDEX IMPROVER

(71) Applicant: CASTROL LIMITED, Pangbourne, Reading (GB)

(72) Inventors: Richard P. Sauer, North Plainfield, NJ (US); Nicholas W. Groeger, Hoboken, NJ (US)

(73) Assignee: Castrol Limited, Reading (GB)

( * ) Notice: Subject to any disclaimer, the term of this patent is extended or adjusted under 35 U.S.C. 154(b) by 0 days.

This patent is subject to a terminal disclaimer.

(21) Appl. No.: 15/487,318

(22) Filed: Apr. 13, 2017

(65) Prior Publication Data

US 2017/0283732 A1 Oct. 5, 2017

Related U.S. Application Data

(63) Continuation of application No. 14/211,184, filed on Mar. 14, 2014, now Pat. No. 9,624,451.
(Continued)

(51) Int. Cl.
*C08G 81/02* (2006.01)
*C10M 149/04* (2006.01)
(Continued)

(52) U.S. Cl.
CPC ..... *C10M 149/14* (2013.01); *C10M 2205/04* (2013.01); *C10M 2205/06* (2013.01);
(Continued)

(58) Field of Classification Search
CPC ..... C10M 2217/06; C10M 2215/04; C08F 265/04
(Continued)

(56) References Cited

U.S. PATENT DOCUMENTS 4,092,255 A 5/1978 Chapelet et al.
4,137,185 A 1/1979 Gardiner et al.
(Continued)

FOREIGN PATENT DOCUMENTS

EP 0172906 3/1986
EP 1446466 8/2004
(Continued)

*Primary Examiner* — Vishal Vasisth
(74) *Attorney, Agent, or Firm* — McDonnell Boehnen Hulbert & Berghoff LLP

(57) ABSTRACT

The present invention provides a multiple function dispersant viscosity index improver, a method of making the multiple function dispersant viscosity index improver, and a lubricating oil comprising the multiple function dispersant viscosity index improver. The multiple function dispersant viscosity index improver comprises two different functional groups, each directly grafted to a polymer backbone having graftable sites. The first functional group comprises the reaction product of an acylating agent and a first amine, the first amine comprising an aromatic primary amine, and the second functional group comprises the reaction product of an acylating agent and a second amine, the second amine comprising an aliphatic primary amine. The first functional group provides the dispersant viscosity index improver with soot handling performance attributes and the second functional group provides the dispersant viscosity index improver with sludge and varnish control performance attributes.

18 Claims, 1 Drawing Sheet

Related U.S. Application Data

(60) Provisional application No. 61/799,192, filed on Mar. 15, 2013.

(51) Int. Cl.
*C08F 271/02* (2006.01)
*C10M 149/14* (2006.01)

(52) U.S. Cl.
CPC . *C10M 2209/084* (2013.01); *C10M 2209/086* (2013.01); *C10M 2217/06* (2013.01); *C10N 2230/04* (2013.01); *C10N 2230/041* (2013.01); *C10N 2240/10* (2013.01); *C10N 2240/102* (2013.01); *C10N 2270/00* (2013.01)

(58) Field of Classification Search
USPC ..... 508/233, 241; 525/281
See application file for complete search history.

(56) References Cited

U.S. PATENT DOCUMENTS

| | | | |
|---|---|---|---|
| 4,146,489 | A | 3/1979 | Stambaugh |
| 4,160,739 | A | 7/1979 | Stambaugh |
| 4,171,273 | A | 10/1979 | Waldbillig et al. |
| 4,173,540 | A | 11/1979 | Lonstrup et al. |
| 4,219,432 | A | 8/1980 | Girgenti et al. |
| 4,320,019 | A | 3/1982 | Hayashi |
| 4,517,104 | A | 5/1985 | Bloch et al. |
| 4,749,505 | A | 6/1988 | Chung et al. |
| 4,863,623 | A | 9/1989 | Nalesnik |
| 5,035,821 | A | 7/1991 | Chung et al. |
| 5,075,383 | A | 12/1991 | Migdal et al. |
| 5,110,489 | A | 5/1992 | Stadler et al. |
| 5,110,490 | A | 5/1992 | Pink et al. |
| 5,167,848 | A | 12/1992 | Chung et al. |
| 5,182,041 | A | 1/1993 | Benfarmeo et al. |
| 5,188,745 | A | 2/1993 | Migdal et al. |
| 5,252,238 | A | 10/1993 | Chung et al. |
| 5,262,075 | A | 11/1993 | Chung et al. |
| 5,290,464 | A | 3/1994 | Chung et al. |
| 5,290,868 | A | 3/1994 | Chung et al. |
| 5,312,556 | A | 5/1994 | Chung et al. |
| 5,356,551 | A | 10/1994 | Chung et al. |
| 5,401,427 | A | 3/1995 | Chung et al. |
| 5,424,367 | A | 6/1995 | Auda et al. |
| 5,439,607 | A | 8/1995 | Patil |
| 5,516,849 | A | 5/1996 | Cines et al. |
| 5,523,008 | A | 6/1996 | Boden et al. |
| 5,614,124 | A | 3/1997 | Esche, Jr. et al. |
| 5,643,859 | A | 7/1997 | Gutierrez et al. |
| 5,663,126 | A | 9/1997 | Boden et al. |
| 5,744,429 | A | 4/1998 | Chung et al. |
| 5,942,471 | A | 8/1999 | Kapuscinski et al. |
| 6,107,256 | A | 8/2000 | Esche, Jr. et al. |
| 6,107,257 | A | 8/2000 | Valcho et al. |
| 6,117,825 | A | 9/2000 | Liu et al. |
| 6,127,481 | A | 10/2000 | Janssen et al. |
| 6,255,387 | B1 | 7/2001 | Olivier et al. |
| 6,916,767 | B2 | 7/2005 | Duyck et al. |
| 7,144,951 | B2 | 12/2006 | Duyck et al. |
| 7,253,231 | B2 | 8/2007 | Devlin et al. |
| 7,371,713 | B2 | 5/2008 | Goldblatt et al. |
| 7,514,383 | B2 | 4/2009 | Goldblatt |
| 7,700,684 | B2 | 4/2010 | Bradley et al. |
| 7,790,661 | B2 | 9/2010 | Covitch et al. |
| 7,833,953 | B2 | 11/2010 | Devlin et al. |
| 7,879,775 | B2 | 2/2011 | Devlin et al. |
| 7,902,133 | B2 | 3/2011 | Devlin et al. |
| 7,981,847 | B2 | 7/2011 | Goldblatt et al. |
| 8,093,189 | B2 | 1/2012 | Devlin et al. |
| 8,263,537 | B2 | 9/2012 | Goldblatt |
| 8,603,954 | B2 | 12/2013 | Sauer |
| 8,703,872 | B2 | 4/2014 | Sauer |
| 8,703,873 | B2 | 4/2014 | Sauer |
| 9,624,451 | B2 | 4/2017 | Sauer et al. |
| 2002/0183473 | A1 | 12/2002 | Matyjaszewski et al. |
| 2005/0101496 | A1 | 5/2005 | Loper et al. |
| 2007/0149414 | A1 | 6/2007 | Ruhe et al. |
| 2008/0119377 | A1 | 5/2008 | Devlin et al. |
| 2008/0293600 | A1 | 11/2008 | Goldblatt et al. |
| 2008/0319119 | A1 | 12/2008 | Waddell et al. |
| 2009/0011963 | A1 | 1/2009 | Anderson et al. |
| 2009/0192061 | A1 | 7/2009 | Boegner et al. |
| 2009/0325831 | A1 | 12/2009 | Mathur et al. |
| 2010/0113315 | A1 | 5/2010 | Meessen et al. |
| 2010/0160193 | A1 | 6/2010 | Harrison et al. |
| 2010/0160194 | A1 | 6/2010 | Harrison et al. |
| 2011/0245119 | A1 | 10/2011 | Sauer |
| 2011/0245120 | A1 | 10/2011 | Bertram et al. |
| 2011/0287992 | A1 | 11/2011 | Goldblatt et al. |
| 2011/0306528 | A1 | 12/2011 | Gieselman et al. |
| 2012/0053095 | A1 | 3/2012 | Tequi et al. |
| 2012/0178656 | A1 | 7/2012 | Sutton et al. |
| 2012/0178659 | A1 | 7/2012 | Price et al. |

FOREIGN PATENT DOCUMENTS

| | | |
|---|---|---|
| EP | 1489281 | 12/2004 |
| GB | 1554947 | 10/1979 |
| GB | 2055852 | 3/1981 |
| WO | 1997/032946 | 9/1997 |
| WO | 2003/020853 | 3/2003 |
| WO | 2006/084698 | 8/2006 |
| WO | 2011/107336 | 9/2011 |
| WO | 2011/146467 | 11/2011 |

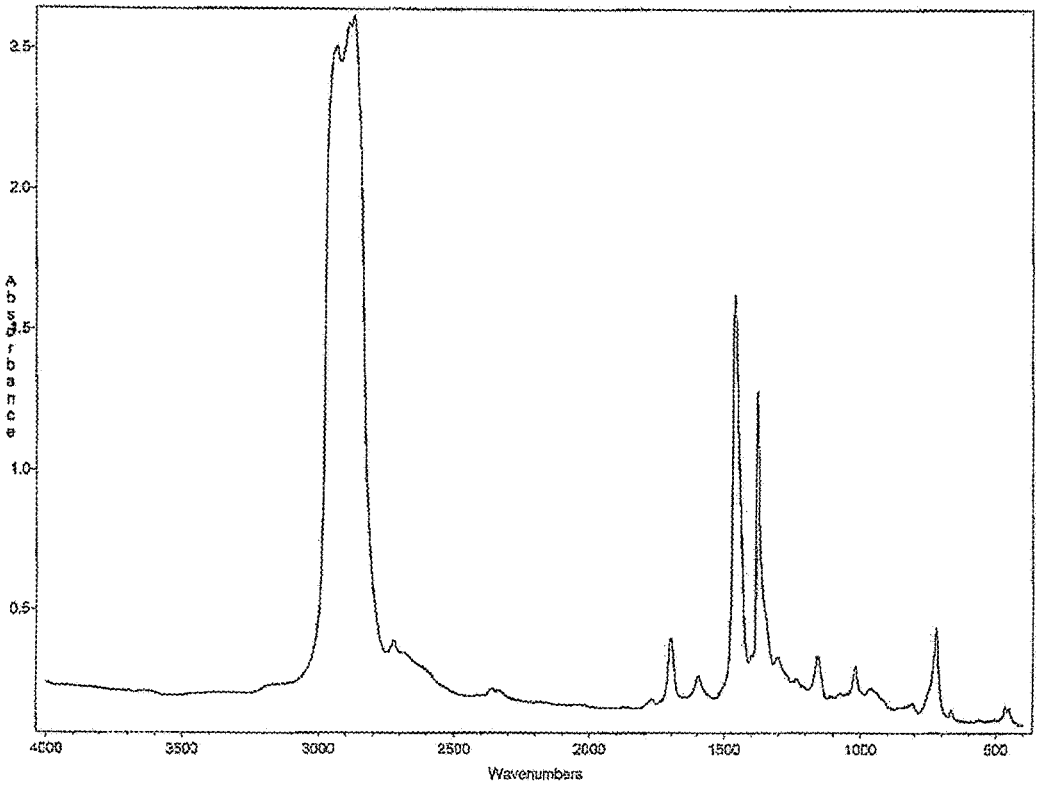
2.5
2.0
1.5
1.0
0.5
Absorbance
4000
3500
3000
2500
2000
1500
1000
500
Wavenumbers

MULTIPLE FUNCTION DISPERSANT VISCOSITY INDEX IMPROVER

The present application is a continuation of U.S. patent application Ser. No. 14/211,184, filed Mar. 14, 2014, now U.S. Pat. No. 9,624,451 which claims priority under 35 U.S.C. § 119(e) to U.S. Provisional Application No. 61/799,192, filed Mar. 15, 2013, each of which is hereby incorporated herein by reference in its entirety.

BACKGROUND OF THE INVENTION

1. Field of the Invention

The present invention relates to novel multiple function dispersant viscosity index improvers comprising a polymer backbone grafted with at least a first functional group associated with sludge and varnish control and at least a second functional group associated with soot handling performance and viscosity control. The present invention also relates to methods for manufacturing the novel multiple function dispersant viscosity index improvers and lubricating oil compositions containing the novel multiple function dispersant viscosity index improvers.

2. Description of the Related Art

Conventional lubricating oils contain a variety of additives, each of which is used to control specific performance characteristics of the lubricating oil.

One common group of lubricating oil additives are dispersant viscosity index improvers having functional groups associated with sludge and varnish control. Among those additives known in the art to be useful as dispersant viscosity index improvers having functional groups associated with sludge and varnish control are polyolefins grafted with nitrogen-containing and/or oxygen-containing monomers. For example, U.S. Pat. No. 5,523,008 describes a dispersant viscosity index improver comprising N-vinylimidazole grafted onto a polyolefin backbone. U.S. Pat. No. 5,663,126 describes a polyolefin having one or more of N-vinylimidazole, 4-vinylpyridine, or other ethylenically-unsaturated nitrogen-containing and/or oxygen-containing monomers grafted to the polyolefin backbone.

Polyolefins grafted with nitrogen-containing and/or oxygen-containing monomers have been prepared by dissolving the selected polyolefin in a solvent, which is typically a lubricating oil base stock, and then mixing the polyolefin solution with a graftable monomer and an organic peroxide as an initiator at conditions effective to graft the graftable monomer to the polyolefin backbone. As described in U.S. Pat. No. 5,523,008, for example, the initiator can be added before, with or after the graftable monomer, but is desirably added so that the amount of unreacted initiator which is present at any given time is preferably a small fraction of the entire charge. The initiator may be introduced into the reactor in several discrete charges, or at a steady rate over an extended period. The organic peroxide initiators used in these processes create an inherently dangerous manufacturing environment.

The lubricating oil base stocks typically used as solvents for the grafting reaction are those having a low content of aromatics. As described in U.S. Pat. No. 5,663,126, for example, the base oil should disperse or dissolve the components of the reaction mixture without materially participating in the reaction or causing side reactions to an unacceptable degree. Thus, aromatic constituents are desirably kept to low levels (if present at all), since aromatic materials may be reactive with each other or other reaction components in the presence of initiators. The reaction components may thus either be wasted or produce unwanted by-products, unless the presence of aromatic constituents is small. For this reason Group II base stocks, which are essentially free of unsaturated aromatics, but which are expensive in comparison to Group I base stocks, are typically used as the solvent for the grafting reaction.

Another common group of lubricating oil additives are dispersant viscosity index improvers having functional groups associated with soot handling performance and viscosity control. Among those additives known in the art to be useful as dispersant viscosity index improvers having functional groups associated with soot handling performance and viscosity control are polyolefins grafted with the reaction product of an acylating agent and an amine. U.S. Pat. No. 4,320,019 describes dispersant viscosity index improvers prepared by first grafting a polyolefin with an acylating agent to form an acylating reaction intermediate and then further reacting the acylating reaction intermediate with an amine. U.S. Pat. No. 7,371,713 describes dispersant viscosity index improvers having functional groups associated with soot handling performance and viscosity control being prepared by first reacting an acylating agent, such as maleic anhydride, with an amine, such as an aromatic amine, and then grafting the product of that reaction onto a polyolefin.

Each additive is a separate component of the formulated lubricating oil and thus increases the cost of the formulated lubricating oil. Thus, it is beneficial to have a multi-functional additive that controls more than one performance characteristic of the lubricating oil. To that end, U.S. Patent Application Publication No. 2008/0293600 describes a multifunctional grafted polymer containing two functional groups grafted to a polymer backbone. A first functional group is associated with sludge and varnish handling and comprises ethylenically unsaturated, aliphatic or aromatic monomers having 2 to about 50 carbon atoms and containing oxygen and/or nitrogen. A second functional group is associated with soot handling performance and viscosity control and comprises the reaction product of an acylating agent and an amine.

As described in U.S. Patent Application Publication No. 2008/0293600, the process for preparing the multifunctional graft polymer is important. To achieve good performance with respect to both soot handling and sludge and varnish control, it is important to first graft an acylating agent, such as maleic anhydride, onto the polymer backbone, forming a polymer containing acyl groups, for example, succinic anhydride groups. Next, the monomer or monomer grouping associated with sludge and varnish handling, for example N-vinylimidazole, is grafted onto the polymer backbone. Finally, the amine or amines capable of undergoing a reaction with the acyl group is introduced and reacted with the acylated polymer thereby imparting soot handling performance to the graft polymer.

The multiple function dispersant viscosity index improvers of embodiments of the present invention provide numerous benefits over the multi-functional additives described in U.S. Patent Application Publication No. 2008/0293600. To prepare the multi-functional additive described in U.S. Patent Application Publication No. 2008/0293600, two different substituents are grafted to the polymer backbone. First, an acylating agent, such as maleic anhydride, is grafted to the polymer backbone. This grafting reaction typically involves the use of an initiator, such as an organic peroxide, and is typically performed in a Group II lubricating base oil.

Second, the functional group associated with sludge and varnish handling, for example, N-vinylimidazole, is grafted directly to the polymer backbone. This grafting reaction also typically involves the use of an initiator, such as an organic peroxide, and is typically performed in a Group II lubricating base oil.

On the other hand, using embodiments of the present invention, only one substituent may be grafted to the polymer backbone. It has been found that the functional group associated with sludge and varnish handling may be the reaction product of an acylating agent and an amine. Accordingly, multiple function dispersant viscosity index improvers may be prepared using only one grafting reaction—the grafting of an acylating agent, such as maleic anhydride, to the polymer backbone. The grafted acylating agent may then be reacted with two different amines in order to produce the first and second functional groups. Thus, it has been found that multiple function dispersant viscosity index improvers may be prepared while minimizing the use of organic peroxide initiators and Group II lubricating base oils. As a result, it has been found that multiple function dispersant viscosity index improvers may be prepared at lower cost and in a safer and more environmentally friendly manufacturing environment.

SUMMARY OF THE INVENTION

It has been found that the current method and composition are useful for providing a multiple function dispersant viscosity index improver comprising a grafted polymer having two different functional groups grafted to the polymer backbone, one functional group being associated with sludge and varnish handling and another functional group being associated with soot handling performance and viscosity control.

In one embodiment, there is provided a multiple function dispersant graft polymer comprising two different functional groups, each directly grafted to a polymer backbone having graftable sites. The first functional group comprises the reaction product of an acylating agent and a first amine, the first amine comprising an aromatic primary amine, and the second functional group comprises the reaction product of an acylating agent and a second amine, the second amine comprising an aliphatic primary amine. The multiple function dispersant graft polymer has a Rapid ADT response of at least about 8.

In another embodiment, there is provided a multiple function dispersant graft polymer comprising two different functional groups, each directly grafted to a polymer backbone having graftable sites. The first functional group comprises the reaction product of an acylating agent and a first amine, the first amine comprising an aromatic primary amine, and the second functional group comprises the reaction product of an acylating agent and a second amine, the second amine comprising an aliphatic primary amine. The multiple function dispersant graft polymer has at least about 5 moles of each functional group per mole of polymer backbone.

In another embodiment, there is provided a multiple function dispersant graft polymer comprising two different functional groups, each directly grafted to a polymer backbone having graftable sites. The first functional group comprises the reaction product of an acylating agent and a first amine, the first amine comprising an aromatic primary amine, and the second functional group comprises the reaction product of an acylating agent and a second amine, the second amine comprising an aliphatic primary amine. The first functional group and the second functional group are present in a molar ratio between 1:1.5 and 1.5:1.

In another embodiment, there is provided a multiple function dispersant graft polymer comprising two different functional groups, each directly grafted to a polymer backbone having graftable sites. The first functional group comprises the reaction product of an acylating agent and a first amine, the first amine comprising an aromatic primary amine, and the second functional group comprises the reaction product of an acylating agent and a second amine, the second amine comprising an aliphatic primary amine. The multiple function dispersant graft polymer, when present in base oil in an amount of about 0.80% solids by weight or below, produces a passing result in a Sequence VG Engine Test.

In another embodiment, there is provided a multiple function dispersant graft polymer comprising two different functional groups, each directly grafted to a polymer backbone having graftable sites. The first functional group comprises the reaction product of an acylating agent and a first amine, the first amine comprising an aromatic primary amine, and the second functional group comprises the reaction product of an acylating agent and a second amine, the second amine comprising an aliphatic primary amine. The multiple function dispersant graft polymer, when present in base oil in an amount of about 0.80% solids by weight or below, produces an Average Engine Sludge, as measured via a Sequence VG Engine Test, of at least 8.

In another embodiment, there is provided a multiple function dispersant graft polymer comprising two different functional groups, each directly grafted to a polymer backbone having graftable sites. The first functional group comprises the reaction product of an acylating agent and a first amine, the first amine comprising an aromatic primary amine, and the second functional group comprises the reaction product of an acylating agent and a second amine, the second amine comprising an aliphatic primary amine. The multiple function dispersant graft polymer, when present in base oil in an amount of about 0.80% solids by weight or below, produces an Average Engine Varnish, as measured via a Sequence VG Engine Test, of at least 8.9.

In another embodiment, there is provided a multiple function dispersant graft polymer comprising two different functional groups, each directly grafted to a polymer backbone having graftable sites. The first functional group comprises the reaction product of an acylating agent and a first amine, the first amine comprising an aromatic primary amine, and the second functional group comprises the reaction product of an acylating agent and a second amine, the second amine comprising an aliphatic primary amine. The multiple function dispersant graft polymer, when present in base oil in an amount of about 0.80% solids by weight or below, produces a passing result in a Peugeot XUD11 Screener Engine Test.

In another embodiment, there is provided a multiple function dispersant graft polymer comprising two different functional groups, each directly grafted to a polymer backbone having graftable sites. The first functional group comprises the reaction product of an acylating agent and a first amine, the first amine comprising an aromatic primary amine, and the second functional group comprises the reaction product of an acylating agent and a second amine, the second amine comprising an aliphatic primary amine. The multiple function dispersant graft polymer, when present in base oil in an amount of about 0.80% solids by weight or below, produces a passing result in a DV4 Test.

In another embodiment, there is provided a multiple function dispersant graft polymer comprising two different functional groups, each directly grafted to a polymer backbone having graftable sites. The first functional group comprises the reaction product of an acylating agent and a first amine, the first amine comprising an aromatic primary amine, and the second functional group comprises the reaction product of an acylating agent and a second amine, the second amine comprising an aliphatic primary amine. The multiple function dispersant graft polymer, when present in base oil in an amount of about 0.80% solids by weight or below, produces a passing result in both a Sequence VG Engine Test and a DV4Test.

In another embodiment, there is provided a multiple function dispersant graft polymer comprising two different functional groups, each directly grafted to a polymer backbone having graftable sites. The first functional group comprises the reaction product of an acylating agent and a first amine, the first amine comprising an aromatic primary amine, and the second functional group comprises the reaction product of an acylating agent and a second amine, the second amine comprising an aliphatic primary amine. The multiple function dispersant graft polymer, when present in base oil in an amount of about 0.80% solids by weight or below, produces a passing result in both a Sequence VG Engine Test and a Peugeot XUD11 Screener Engine Test.

In another embodiment, there is provided a multiple function dispersant graft polymer comprising two different functional groups, each directly grafted to a polymer backbone having graftable sites. The first functional group comprises the reaction product of an acylating agent and a first amine, the first amine comprising an aromatic primary amine, and the second functional group comprises the reaction product of an acylating agent and a second amine, the second amine comprising an aliphatic primary amine. The multiple function dispersant graft polymer, when present in base oil in an amount of about 0.80% solids by weight or below, produces a passing result in both a Sequence VG Engine Test and a Peugeot XUD11 Screener Engine Test.

In another embodiment, there is provided a method of making a multiple function dispersant graft polymer comprising (a) reacting a polymer backbone having graftable sites and an acylating agent having at least one point of olefinic unsaturation to form a graft polymer reaction product having acyl groups available for reaction, (b) reacting the reaction product of step a with a first amine comprising an aromatic primary amine to form a graft polymer reaction product having a first functional group and acyl groups available for reaction, and (c) reacting the reaction product of step b with a second amine comprising an aliphatic primary amine to form a graft reaction product having a first functional group and a second functional group. The method may be carried out so as to obtain a multiple function dispersant graft polymer having a Rapid ADT response of at least about 8.

In another embodiment, there is provided a method of making a multiple function dispersant graft polymer comprising (a) reacting a polymer backbone having graftable sites and an acylating agent having at least one point of olefinic unsaturation to form a graft polymer reaction product having acyl groups available for reaction, (b) reacting the reaction product of step a with a first amine comprising an aromatic primary amine to form a graft polymer reaction product having a first functional group and acyl groups available for reaction, and (c) reacting the reaction product of step b with a second amine comprising an aliphatic primary amine to form a graft reaction product having a first functional group and a second functional group. The method may be carried out so as to obtain a multiple function dispersant graft polymer having at least about 5 moles of each functional group per mole of polymer backbone.

In another embodiment, there is provided a method of making a multiple function dispersant graft polymer comprising (a) reacting a polymer backbone having graftable sites and an acylating agent having at least one point of olefinic unsaturation to form a graft polymer reaction product having acyl groups available for reaction, (b) reacting the reaction product of step a with a first amine comprising an aromatic primary amine to form a graft polymer reaction product having a first functional group and acyl groups available for reaction, and (c) reacting the reaction product of step b with a second amine comprising an aliphatic primary amine to form a graft reaction product having a first functional group and a second functional group. The method may be carried out so as to obtain a multiple function dispersant graft polymer having the first functional group and the second functional group present in a molar ratio between 1:1.5 and 1.5:1.

In another embodiment, there is provided a method of making a multiple function dispersant graft polymer comprising (a) reacting a polymer backbone having graftable sites and an acylating agent having at least one point of olefinic unsaturation to form a graft polymer reaction product having acyl groups available for reaction, (b) reacting the reaction product of step a with a first amine comprising an aromatic primary amine to form a graft polymer reaction product having a first functional group and acyl groups available for reaction, and (c) reacting the reaction product of step b with a second amine comprising an aliphatic primary amine to form a graft reaction product having a first functional group and a second functional group. The method may be carried out so as to obtain a multiple function dispersant graft polymer that, when present in base oil in an amount of about 0.80% solids by weight or below, produces a passing result in a Sequence VG Engine Test.

In another embodiment, there is provided a method of making a multiple function dispersant graft polymer comprising (a) reacting a polymer backbone having graftable sites and an acylating agent having at least one point of olefinic unsaturation to form a graft polymer reaction product having acyl groups available for reaction, (b) reacting the reaction product of step a with a first amine comprising an aromatic primary amine to form a graft polymer reaction product having a first functional group and acyl groups available for reaction, and (c) reacting the reaction product of step b with a second amine comprising an aliphatic primary amine to form a graft reaction product having a first functional group and a second functional group. The method may be carried out so as to obtain a multiple function dispersant graft polymer that, when present in base oil in an amount of about 0.80% solids by weight or below, produces an Average Engine Sludge, as measured via a Sequence VG Engine Test, of at least 8.

In another embodiment, there is provided a method of making a multiple function dispersant graft polymer comprising (a) reacting a polymer backbone having graftable sites and an acylating agent having at least one point of olefinic unsaturation to form a graft polymer reaction product having acyl groups available for reaction, (b) reacting the reaction product of step a with a first amine comprising an aromatic primary amine to form a graft polymer reaction product having a first functional group and acyl groups available for reaction, and (c) reacting the reaction product of step b with a second amine comprising an aliphatic primary amine to form a graft reaction product having a first functional group and a second functional group. The method may be carried out so as to obtain a multiple function dispersant graft polymer that, when present in base oil in an amount of about 0.80% solids by weight or below, produces an Average Engine Varnish, as measured via a Sequence VG Engine Test, of at least 8.9.

In another embodiment, there is provided a method of making a multiple function dispersant graft polymer comprising (a) reacting a polymer backbone having graftable sites and an acylating agent having at least one point of olefinic unsaturation to form a graft polymer reaction product having acyl groups available for reaction, (b) reacting the reaction product of step a with a first amine comprising an aromatic primary amine to form a graft polymer reaction product having a first functional group and acyl groups available for reaction, and (c) reacting the reaction product of step b with a second amine comprising an aliphatic primary amine to form a graft reaction product having a first functional group and a second functional group. The method may be carried out so as to obtain a multiple function dispersant graft polymer that, when present in base oil in an amount of about 0.80% solids by weight or below, produces a passing result in a Peugeot XUD11 Screener Engine Test.

In another embodiment, there is provided a method of making a multiple function dispersant graft polymer comprising (a) reacting a polymer backbone having graftable sites and an acylating agent having at least one point of olefinic unsaturation to form a graft polymer reaction product having acyl groups available for reaction, (b) reacting the reaction product of step a with a first amine comprising an aromatic primary amine to form a graft polymer reaction product having a first functional group and acyl groups available for reaction, and (c) reacting the reaction product of step b with a second amine comprising an aliphatic primary amine to form a graft reaction product having a first functional group and a second functional group. The method may be carried out so as to obtain a multiple function dispersant graft polymer that, when present in base oil in an amount of about 0.80% solids by weight or below, produces a passing result in a DV4 Test.

In another embodiment, there is provided a method of making a multiple function dispersant graft polymer comprising (a) reacting a polymer backbone having graftable sites and an acylating agent having at least one point of olefinic unsaturation to form a graft polymer reaction product having acyl groups available for reaction, (b) reacting the reaction product of step a with a first amine comprising an aromatic primary amine to form a graft polymer reaction product having a first functional group and acyl groups available for reaction, and (c) reacting the reaction product of step b with a second amine comprising an aliphatic primary amine to form a graft reaction product having a first functional group and a second functional group. The method may be carried out so as to obtain a multiple function dispersant graft polymer that, when present in base oil in an amount of about 0.80% solids by weight or below, produces a passing result in both a Sequence VG Engine Test and a DV4Test.

In another embodiment, there is provided a method of making a multiple function dispersant graft polymer comprising (a) reacting a polymer backbone having graftable sites and an acylating agent having at least one point of olefinic unsaturation to form a graft polymer reaction product having acyl groups available for reaction, (b) reacting the reaction product of step a with a first amine comprising an aromatic primary amine to form a graft polymer reaction product having a first functional group and acyl groups available for reaction, and (c) reacting the reaction product of step b with a second amine comprising an aliphatic primary amine to form a graft reaction product having a first functional group and a second functional group. The method may be carried out so as to obtain a multiple function dispersant graft polymer that, when present in base oil in an amount of about 0.80% solids by weight or below, produces a passing result in both a Sequence VG Engine Test and a Peugeot XUD11 Screener Engine Test.

In another embodiment, there is provided a method of making a multiple function dispersant graft polymer comprising (a) reacting a polymer backbone having graftable sites and an acylating agent having at least one point of olefinic unsaturation to form a graft polymer reaction product having acyl groups available for reaction, (b) reacting the reaction product of step a with a first amine comprising an aromatic primary amine to form a graft polymer reaction product having a first functional group and acyl groups available for reaction, and (c) reacting the reaction product of step b with a second amine comprising an aliphatic primary amine to form a graft reaction product having a first functional group and a second functional group. The method may be carried out so as to obtain a multiple function dispersant graft polymer that, when present in base oil in an amount of about 0.80% solids by weight or below, produces a passing result in both a Sequence VG Engine Test and a Peugeot XUD11 Screener Engine Test.

In another embodiment, there is provided a method of making a multiple function dispersant graft polymer comprising (a) obtaining a graft polymer having acyl groups available for reaction, (b) reacting the graft polymer of step a with a first amine comprising an aromatic primary amine in a solvent comprising a base oil that has an aromatic content of at least 7% by weight, to form a graft polymer reaction product having a first functional group and acyl groups available for reaction, and (c) reacting the reaction product of step b with a second amine comprising an aliphatic primary amine in a solvent comprising a base oil that has an aromatic content of at least 7% by weight, to form a graft reaction product having a first functional group and a second functional group.

In another embodiment, there is provided a method of making a multiple function dispersant graft polymer comprising (a) obtaining a graft polymer having acyl groups available for reaction, (b) reacting the graft polymer of step a with a first amine comprising an aromatic primary amine in a solvent comprising a base oil that has an aromatic content of at least 10% by weight, to form a graft polymer reaction product having a first functional group and acyl groups available for reaction, and (c) reacting the reaction product of step b with a second amine comprising an aliphatic primary amine in a solvent comprising a base oil that has an aromatic content of at least 10% by weight, to form a graft reaction product having a first functional group and a second functional group.

In another embodiment, there is provided a lubricating oil comprising a lubricating base oil and between about 0.05 to about 10% by composition weight of the multiple function dispersant graft polymer of the present invention. In another embodiment, there is provided a lubricating oil comprising a lubricating base oil and between about 0.3 to about 1.0% by composition weight of the multiple function dispersant graft polymer of the present invention.

BRIEF DESCRIPTION OF THE DRAWINGS

A clear conception of the advantages and features of one or more embodiments will become more readily apparent by reference to the exemplary, and therefore non-limiting, embodiments illustrated in the drawings:

FIG. 1 is an FT-IR Spectrum identifying a multiple function graft polymer prepared in accordance with an embodiment of the present invention.

DETAILED DESCRIPTION OF THE INVENTION

While the invention will be described in connection with one or more preferred embodiments, it will be understood that the invention is not limited to those embodiments. On the contrary, the invention includes all alternatives, modifications and equivalents as may be included within the spirit and scope of the appended claims.

Polymers

A wide variety of polyolefins, polyesters, and styrene-butadiene copolymers (any of which may or may not have pendant unsaturation) are contemplated for use as a polymer backbone for grafting. Examples of such polyolefins and polyesters include homopolymers, copolymers, terpolymers, and higher such as, but not limited to, polyethylene, polypropylene, ethylene-propylene copolymers, polymers containing two or more monomers, polyisobutene, polymethacrylates, polyacrylates, polyalkylstyrenes, partially hydrogenated polyolefins of butadiene and styrene and copolymers of isoprene, such as polymers of styrene and isoprene. EPDM (ethylene/propylene/diene monomer) polymers, ethylene-propylene octene terpolymers and ethylene-propylene ENB terpolymers, are also contemplated for use herein. The use of mixtures of polyolefins, mixtures of polyesters, or mixtures of styrene-butadiene polymers is also contemplated. The use of chemical and physical mixtures of polyolefins, polyesters, and/or styrene-butadiene polymers is also contemplated.

The polyolefins contemplated herein may have weight average molecular weights of from about 10,000 to about 750,000, alternatively from about 20,000 to about 500,000. Preferred polyolefins may have polydispersities from about 1 to about 15. The polyesters contemplated herein may have weight average molecular weights of from about from about 10,000 to about 1,000,000, alternatively from about 20,000 to about 750,000.

Particular materials contemplated for use herein include ethylene/propylene/diene polyolefins containing from about 30% to about 80% ethylene and from about 70% to about 20% propylene moieties by number, optionally modified with from 0% to about 15% diene monomers. Several examples of diene monomers are 1,4-butadiene, isoprene, 1,4-hexadiene, dicyclopentadiene, 2,5-norbornadiene, ethylidene-norbornene, the dienes recited in U.S. Pat. No. 4,092,255, the disclosure of which is incorporated herein by reference in its entirety, at column 2, lines 36-44, or combinations of more than one of the aforementioned polymers. Other materials contemplated are polymers derived from mixed alkylacrylates or mixed alkylmethacrylates or combinations thereof.

Specific materials which are contemplated for use herein include the VISNEX polyolefins which are polyolefins comprised of ethylene and propylene sold by Mitsui Petrochemical Industries, Ltd., Tokyo, Japan; also the family of PARATONE polyolefins, such as Paratone 8910, and Paratone 8941, comprised primarily of ethylene and propylene, marketed by Chevron Oronite Company, L.L.C., headquartered in Houston, Tex.; also contemplated are Infineum SV200, Infineum SV250, Infineum SV145, Infineum SV160, Infineum SV300, and Infineum SV150, which are olefin copolymers based on ethylene and/or propylene and/or isoprene marketed by Infineum International, Ltd., Abingdon, UK. or Infineum USA LP, Linden, N.J.; elastomers available from DSM are also contemplated, as are polymers marketed under the DUTRAL name by Polimeri Europa, of Ferrara, Italy such as CO-029, CO-034, CO-043, CO-058, TER 4028, TER 4044, TER 4049 and TER 9046. The Uniroyal line of polymers marketed by Crompton Corporation of Middlebury, Conn. under the ROYALENE name such as 400, 501, 505, 512, 525, 535, 556, 563, 580 HT are also contemplated. Styrene-butadiene polymers, such as Lubrizol®7408, sold by The Lubrizol Corporation, headquartered in Wickliffe, Ohio, are also contemplated. Also contemplated for use are polymers such as Viscoplex 3-700, a polyalkyl methacrylate and Viscoplex 2-602, a dispersant mixed polymer which consists of polyalkyl methacrylate coreacted with olefin copolymer.

Combinations of the above materials, and other, similar materials are also contemplated.

Acylating Agents

The acylating agent has at least one point of olefinic unsaturation in its structure. Usually, the point of olefinic unsaturation will correspond to —HC═CH— or —HC═$CH_2$. Acylating agents where the point of olefinic unsaturation is α, β to a carboxy functional group are very useful. Olefinically unsaturated mono-, di-, and polycarboxylic acids, the lower alkyl esters thereof, the halides thereof, and the anhydrides thereof represent typical acylating agents in accordance with embodiments of the present invention. Preferably, the olefinically unsaturated acylating agent is a mono- or dibasic acid, or a derivative thereof such as anhydrides, lower alkyl esters, halides and mixtures of two or more such derivatives. "Lower alkyl" means alkyl groups having one to seven carbon atoms.

The acylating agent may include at least one member selected from the group consisting of monounsaturated $C_4$ to $C_{50}$, alternatively $C_4$ to $C_{20}$, alternatively $C_4$ to $C_{10}$, dicarboxylic acids, monocarboxylic acids, and anhydrides thereof (that is, anhydrides of those carboxylic acids or of those monocarboxylic acids), and combinations of any of the foregoing acids and/or anhydrides.

Suitable acylating agents include acrylic acid, crotonic acid, methacrylic acid, maleic acid, maleic anhydride, fumaric acid, itaconic acid, itaconic anhydride, citraconic acid, citraconic anhydride, mesaconic acid, glutaconic acid, chloromaleic acid, aconitic acid, methylcrotonic acid, sorbic acid, 3-hexenoic acid, 10-decenoic acid, 2-pentene-1,3,5-tricarboxylic acid, cinnamic acid, and lower alkyl (e.g., $C_1$ to $C_4$ alkyl) acid esters of the foregoing, e.g., methyl maleate, ethyl fumarate, methyl fumarate, and the like. The acylating agents may include the unsaturated dicarboxylic acids and their derivatives; especially maleic acid, fumaric acid, maleic anhydride, and combinations thereof.

Amines for Forming Functional Groups Associated with Soot Handling Performance

Amines suitable for imparting soot handling performance are those having an aromatic primary amine which is capable of undergoing a condensation reaction with an appropriate acylating agent. Amines comprising more than one aromatic group and/or a functional group, such as nitrogen or oxygen, that provides the amine with a degree of polarity may be useful for imparting soot handling performance. One or more amines may be used. Some examples of amines that are suitable for imparting soot handling performance include aniline; N,N-dimethyl-p-phenylenediamine; 1-naphthylamine; N-phenyl-p-phenylenediamine (also known as 4-aminodiphenylamine or ADPA); m-anisidine; 3-amino-4-methylpyridine; 4-nitroaniline; and combinations thereof.

Amines for Forming Functional Groups Associated with Sludge and Varnish Control

Amines suitable for imparting sludge and varnish control performance are those having an aliphatic primary amine which is capable of undergoing a condensation reaction with an appropriate acylating agent and having a degree of polarity (such as may be provided by a nitrogen or oxygen group). One or more amines may be used. Some examples of amines that are suitable for imparting sludge and varnish control performance include 2,2-dimethyl-1,3-dioxolane-4-methanamine; n-(3-aminopropyl) imidazole; N-(3-aminopropyl)-2-pyrrolidinone; 2-picolylamine; and combinations thereof.

Amounts of Each Functional Group on the Graft Polymer

In order to be effective for both soot handling and sludge and varnish control, a multiple function dispersant graft polymer should comprise at least a minimum amount of a first functional group associated with soot handling performance and at least a minimum amount of a second functional group associated with sludge and varnish control.

It is contemplated that the minimum effective amount of a first functional group associated with soot handling performance is at least about 4 moles functional group per mole of starting polymer, alternatively at least about 5 moles functional group per mole of starting polymer, alternatively at least about 6 moles functional group per mole of starting polymer, alternatively at least about 7 moles functional group per mole of starting polymer, alternatively at least about 8 moles functional group per mole of starting polymer.

It is contemplated that the minimum effective amount of a second functional group associated with sludge and varnish control is at least about 4 moles functional group per mole of starting polymer, alternatively at least about 5 moles functional group per mole of starting polymer, alternatively at least about 6 moles functional group per mole of starting polymer, alternatively at least about 7 moles functional group per mole of starting polymer, alternatively at least about 8 moles functional group per mole of starting polymer.

If either functional group is present on the graft polymer in an amount below the minimum effective amount, the graft polymer may be unsuitable as a multiple function dispersant viscosity index improver as contemplated by the present disclosure.

The maximum amount of the first functional group that may be present on a graft polymer is limited only by the amount of acyl groups on the polymer backbone, which is limited by the amount of graftable sites on the polymer backbone (it should also be taken into account that some of the acyl groups should be reacted to form the second functional group). At some point, however, the formation of additional functional groups associated with soot handling performance may become inefficient or unnecessary. Thus, in embodiments, a graft polymer comprises the first functional group associated with soot handling performance in an amount between 4 moles functional group per mole of starting polymer and 15 moles functional group per mole of starting polymer, alternatively between 5 moles functional group per mole of starting polymer and 15 moles functional group per mole of starting polymer, alternatively between 6 moles functional group per mole of starting polymer and 15 moles functional group per mole of starting polymer, alternatively between 7 moles functional group per mole of starting polymer and 15 moles functional group per mole of starting polymer, alternatively between 8 moles functional group per mole of starting polymer and 15 moles functional group per mole of starting polymer, alternatively between 9 moles functional group per mole of starting polymer and 15 moles functional group per mole of starting polymer, alternatively between 4 moles functional group per mole of starting polymer and 12 moles functional group per mole of starting polymer alternatively between 5 moles functional group per mole of starting polymer and 12 moles functional group per mole of starting polymer, alternatively between 6 moles functional group per mole of starting polymer and 12 moles functional group per mole of starting polymer, alternatively between 7 moles functional group per mole of starting polymer and 12 moles functional group per mole of starting polymer, alternatively between 8 moles functional group per mole of starting polymer and 12 moles functional group per mole of starting polymer, alternatively between 9 moles functional group per mole of starting polymer and 12 moles functional group per mole of starting polymer.

The maximum amount of the second functional group that may be present on a graft polymer is limited only by the amount of acyl groups on the polymer backbone, which is limited by the amount of graftable sites on the polymer backbone (it should also be taken into account that some of the acyl groups should be reacted to form the first functional group). At some point, however, the formation of additional functional groups associated with sludge and varnish control may become inefficient or unnecessary. Thus, in embodiments, a graft polymer comprises the second functional group associated with sludge and varnish control in an amount between 4 moles functional group per mole of starting polymer and 15 moles functional group per mole of starting polymer, alternatively between 5 moles functional group per mole of starting polymer and 12 moles functional group per mole of starting polymer, alternatively between 6 moles functional group per mole of starting polymer and 12 moles functional group per mole of starting polymer, alternatively between 7 moles functional group per mole of starting polymer and 12 moles functional group per mole of starting polymer, alternatively between 8 moles functional group per mole of starting polymer and 12 moles functional group per mole of starting polymer, alternatively between 9 moles functional group per mole of starting polymer and 12 moles functional group per mole of starting polymer.

In order that the graft polymer may comprise each of the soot handling functional group and the sludge and the varnish control functional group in effective amounts, the graft polymer may comprise the soot handling functional group and the sludge and varnish control functional group in a molar ratio between about 1.5 to 1 and 1 to 1.5, alternatively between about 1.4 to 1 and 1 to 1.4, alternatively between about 1.3 to 1 and 1 to 1.3, alternatively between about 1.2 to 1 and 1 to 1.2, alternatively between about 1.1 to 1 and 1 to 1.1. Alternatively, the graft polymer comprises the soot handling functional group and the sludge and varnish control functional group in a ratio of about 1:1.

More particularly, the functional group associated with soot handling may make up between 40% and 60% of the total moles of functional groups on the graft polymer, alternatively between 41% and 59%, alternatively between 42% and 58%, alternatively between 43% and 57%, alternatively between 44% and 56%, and alternatively between 45% and 55% of the total moles of functional groups on the graft polymer. Similarly, the functional group associated with sludge and varnish control may makes up between 40% and 60% of the total moles of functional groups on the graft polymer, alternatively between 41% and 59%, alternatively between 42% and 58%, alternatively between 43% and 57%, alternatively between 44% and 56%, and alternatively between 45% and 55% of the total moles of functional groups on the graft polymer.

If either functional group is present in a percentage of the total functional groups on the graft polymer that is too low, the graft polymer will likely contain that functional group in an amount that falls below the minimum effective amount. Accordingly, such a graft polymer may be unsuitable as a multiple function dispersant viscosity index improver as contemplated by the present disclosure.

Free-Radical Initiators

Broadly, any free-radical initiator capable of operating under the conditions of the reaction between the acylating agent and the polymer is contemplated for use. Representative initiators are disclosed in U.S. Pat. No. 4,146,489, the disclosure of which is incorporated herein by reference in its entirety, at column 4, lines 45-53. Specific "peroxy" initiators contemplated include alkyl, dialkyl, and aryl peroxides, for example: di-t-butyl peroxide (abbreviated herein as "DTBP"), dicumyl peroxide, t-butyl cumyl peroxide, benzoyl peroxide, 2,5-dimethyl-2,5-di(t-butylperoxy)hexane, and 2,5-dimethyl-2,5-di(t-butylperoxy)hexyne-3. Also contemplated are peroxyester and peroxyketal initiators, for example: t-butylperoxy benzoate, t-amylperoxy benzoate, t-butylperoxy acetate, t-butylperoxy benzoate, di-t-butyl diperoxyphthalate, and t-butylperoxy isobutyrate. Also contemplated are hydroperoxides, for example: cumene hydroperoxide, t-butyl hydroperoxide, and hydrogen peroxide. Also contemplated are azo initiators, for example: 2-t-butylazo-2-cyanopropane, 2-t-butylazo-1-cyanocyclohexane, 2,2'-azobis(2,4-dimethylpentane nitrile), 2,2'-azobis(2-methylpropane nitrile), 1,1'-azobis(cyclohexanecarbonitrile), and azoisobutyronitrile (AIBN). Other similar materials are also contemplated such as, but not limited to, diacyl peroxides, ketone peroxides and peroxydicarbonates. It is also contemplated that combinations of more than one initiator, including combinations of different types of initiators, may be employed.

Solvents

Either polar or non-polar solvents or process fluids may be used. Such solvents facilitate materials handling as well as promote the uniform distribution of reactants. The process fluids useful here include volatile solvents which are readily removable from the grafted polymer after the reaction is complete. Solvents which may be used are those which can disperse or dissolve the components of the reaction mixture and which will not participate appreciably in the reaction or cause side reactions to a material degree. Several examples of solvents of this type include straight chain or branched aliphatic or alicyclic hydrocarbons, such as n-pentane, n-heptane, i-heptane, n-octane, i-octane, nonane, decane, cyclohexane, dihydronaphthalene, decahydronaphthalene and others. Specific examples of polar solvents include aliphatic ketones (for example, acetone), aromatic ketones, ethers, esters, amides, nitrites, sulfoxides such as dimethyl sulfoxide, water, and the like. Non-reactive halogenated aromatic hydrocarbons such as chlorobenzene, dichlorobenzene, trichlorobenzene, dichlorotoluene and others are also useful as solvents. Combinations of solvents, such as-of polar and non-polar solvents, are also contemplated for use in the present invention.

The solvents and process fluids useful here also include base stocks which are suitable for incorporation into a final lubricating oil product. Any base stock may be used which can disperse or dissolve the components of the reaction mixture without materially participating in the reaction or causing side reactions to an unacceptable degree. Hydroisomerized and hydrocracked base stocks, base stocks containing low or moderate levels of aromatic constituents, and fluid poly-α-olefins are contemplated for use herein. For the grafting reaction, aromatic constituents are desirably kept to low levels since aromatic materials may be reactive with each other or other reaction components in the presence of initiators. The use of base stocks having aromatic constituents, while being less than optimum for the grafting reaction, is contemplated under this disclosure. These include base stocks containing less than 50% aromatics, alternatively less than 30% aromatics, alternatively less than 25% aromatics, alternatively less than 20% aromatics, alternatively less than 10% aromatics or alternatively less than 5% aromatics.

Suitable base stocks of this kind contemplated include those marketed by ExxonMobil Corp. such as the Group I, 100 SUS, 130 SUS, or 150 SUS low pour solvent neutral base oils, and the Group II EHC base stocks. Representative base stocks include those marketed by PetroCanada, Calgary, Alberta, such as HT 60 (P 60 N), HT 70 (P 70 N), HT 100 (P 100 N), and HT 160 (P 160 N) are also contemplated as well as RLOP stocks such as 100 N and 240 N sold by Chevron USA Products Co. In general, Group I, Group II, Group III, Group IV and Group V base stock categories are contemplated for use. Aromatic-free base stocks such as poly-alpha-olefins ("PAO") may also be used.

The aromatic content in the process fluid may be from about 0 to about 50 weight percent, alternatively, from about 0 to about 25 weight percent, alternatively, from about 0 to about 15 weight percent, alternatively from about 0 to about 10 weight percent, alternatively from about 0 to about 5 weight percent.

The aromatic content of the process fluid used in the condensation reactions of the amines with the acyl groups is far less important, as the condensation reactions take place without the need for a free-radical initiator. Accordingly, the danger of aromatic materials reacting with each other or other reaction components is not present. In embodiments of the present invention base stocks having higher aromatic contents, such as at least about 5% by weight, may be used. Alternatively, base stocks having an aromatic content of at least about 6% by weight may be used. Alternatively, base stocks having an aromatic content of at least about 7% by weight may be used. Alternatively, base stocks having an aromatic content of at least about 8% by weight may be used. Alternatively, base stocks having an aromatic content of at least about 9% by weight may be used. Alternatively, base stocks having an aromatic content of at least about 10% by weight may be used. Alternatively, base stocks having an aromatic content of at least about 12% by weight may be used. Alternatively, base stocks having an aromatic content of at least about 15% by weight may be used. Group I base oils generally have higher aromatic contents within the above ranges. The use of base stocks having higher aromatic contents may provide significant savings in raw material expenses, rendering the multiple function dispersant viscosity index improver and the process of making the multiple function dispersant viscosity index improver disclosed herein more economical than conventional lubricating oils.

Method of Preparation of Multiple Function Dispersant Viscosity Index Improver

To prepare a multi-function graft polymer which displays both good soot handling and sludge and varnish control, the respective functional groups which impart these performance characteristics are grafted onto the same polymer backbone.

The reaction sequence is important as the reaction order is a determinant of the amount of each functional group on the graft polymer and, hence of performance. To achieve good performance with respect to both soot handling and sludge and varnish control, an acylating agent, such as maleic anhydride, is grafted onto the polymer forming a graft polymer reaction product having acyl groups available for reaction, for example, a polymer containing succinic anhydride groups. Next, an amine reactant that is useful for forming the functional group associated with soot handling is introduced and reacted with the acyl groups of the graft polymer reaction product, e.g. succinic anhydride (SA) groups. Finally, am amine reactant that is useful for forming the functional group associated with sludge and varnish control is introduced and reacted with the acyl groups of the graft polymer reaction product, e.g. succinic anhydride (SA) groups. More than one type of reactant may be used in any given step, so the reactants may comprise one or more graftable polymers, one or more graftable acylating agents, one or more amines capable of undergoing reaction with the acyl groups to form a functional group associated with soot handling, and/or one or more amines capable of undergoing reaction with the acyl groups to form a functional group associated with sludge and varnish control are contemplated.

It is important that the amine reactant that is useful for forming the functional group associated with soot handling is introduced and reacted with the acyl groups of the graft polymer prior to the introduction of the amine reactant that is useful for forming the functional group associated with sludge and varnish control because the aromatic amines that are useful for forming the soot handling functional group have a significantly lower reaction rate with the acyl groups of the graft polymer than the aliphatic amines that are useful for forming the sludge and varnish control functional group. By reacting the aromatic amines first, one ensures that there are sufficient un-reacted acyl groups on the graft polymer with which the aromatic amines may react. This ensures that an effective amount of soot handling functional groups may be incorporated onto the polymer. Because the aliphatic amines that are useful for forming the sludge and varnish control functional group have a significantly higher reaction rate, the aliphatic amines are able to react with the remaining un-reacted acyl groups in order to provide an effective amount of sludge and varnish control functional groups. The high reaction rate of the aliphatic amines provides the additional benefit that the acyl groups on the polymer backbone may be fully reacted via a condensation reaction, such that no un-reacted acyl groups are present on the multiple function dispersant viscosity index improver.

Although not being bound by any theory of operation, where the aliphatic amine that is useful for forming the sludge and varnish control functional group is introduced and reacted with the graft polymer containing acyl groups prior to the aromatic amine that is useful for forming the soot handling function group, one may not achieve an effective amount of soot handling functional group on the graft polymer. Additionally, because of the typically low reaction rates of the aromatic amines that are generally useful for forming the soot handling functional group, the resulting graft polymer may contain un-reacted acyl groups. Similarly, if one were to provide a mixture comprising both the aliphatic amine that is useful for forming the sludge and varnish control functional group and the aromatic amine that is useful for forming the soot handling functional group, the graft polymer reaction product may not contain an effective amount of a soot handling functional group.

Using the method described herein, only one free-radical grafting reaction is performed (the grafting of the acylating agent to the polymer backbone). The remainder of the reaction comprises condensation reactions between the two different amines and acyl groups on the polymer backbone. Accordingly, the use of a free-radical initiator, such as an organic peroxide, is required only for the first reaction step. It is also contemplated that the grafting of an acylating agent to the polymer backbone may be performed by an upstream supplier, which would allow one to produce a multiple function dispersant viscosity index improver through the reaction of two different amines with the acylated polymer, as described herein, without having to store and use a potentially harmful free-radical initiator. Grafting of an acylating agent by an upstream supplier would also allow for one to produce a multiple function dispersant viscosity index improver through the reaction of two different amines with the acylated polymer, as described herein, in a less expensive base stock solvent that need not be essentially free of aromatics (such as a Group I base stock). Thus, one may avoid the use of an expensive aromatic-free base stock solvent (such as a Group II base stock).

The multi-functional graft polymer of the present invention may be prepared in solution or by melt blending, or by a combination of melt blending and reaction in solution.

Preparation in Solution

Preparation of the multi-functional graft polymer in solution is generally carried out as follows. The polymer to be grafted is provided in fluid form. For example, the polymer may be dissolved in a solvent, which may be a hydrocarbon base oil suitable for use in a lubricating composition or any other suitable solvent. The polymer solution is then heated to an appropriate reaction temperature. A graftable acylating agent is then introduced and grafted onto the polymer using an initiator such as a peroxide molecule, thereby forming an acylated polymer. For example, when the acylating agent is maleic anhydride, a polymer having succinic anhydride groups is formed. Next, an amine that is capable of undergoing reaction with the acyl groups of the acylated polymer to form a functional group associated with soot handling is introduced to the solution comprising the acylated polymer and reacted for a suitable amount of time. Finally, an amine that is capable of undergoing reaction with the remaining acyl groups of the acylated polymer to form a functional group associated with sludge and varnish control is introduced to the solution and reacted for a suitable amount of time.

More particularly, the polymer solution is placed into a suitable reactor such as a resin kettle and the solution is heated, under inert gas blanketing, to the desired reaction temperature, and the reaction is carried out under an inert gas blanket. At a minimum, the reaction temperature should be sufficient to consume essentially all of the selected initiator during the time allotted for the reaction of the acylating agent and the polymer backbone. For example, if di-t-butyl peroxide (DTBP) is used as the initiator, the reaction temperature should range from about 145° C. to about 220° C., alternatively from about 155° C. to about 210° C., alternatively from about 160° C. to about 200° C., alternatively from about 165° C. to about 190° C., alternatively from about 165° C. to about 180° C., alternatively greater than about 170° C., alternatively greater than about 175° C. Different initiators work at different rates for a given reaction temperature. Therefore, the choice of a particular initiator may require adjustment of reaction temperature or time. Once a temperature is adopted, the temperature is typically maintained constant throughout the entire sequence of processes required in the preparation of the graft polymer (although no further initiator is needed). However, the solution may be allowed to cool to, for example, room temperature following the grafting of the acylating agent to the polymer backbone.

The acylating agent is added to the polymer solution and dissolved. The contemplated proportions of the acylating agent to polymer are selected so that an effective percentage will graft directly onto the polymer backbone. The minimum mole ratio of acylating agent to polymer is as follows: at least about 1 mole, alternatively at least about 2 moles, alternatively at least about 3 moles, alternatively at least about 4 moles, alternatively at least about 5 moles, alternatively at least about 6 moles, alternatively at least about 7 moles, alternatively at least about 8 moles, alternatively at least about 9 moles, alternatively at least about 10 moles, alternatively at least about 11 moles, alternatively at least about 12 moles, alternatively at least about 13 moles, alternatively at least about 14 moles, alternatively at least about 15 moles, alternatively at least about 20 moles, alternatively at least about 25 moles, alternatively at least about 30 moles, alternatively at least about 40 moles, alternatively at least about 50 moles, alternatively at least about 60 moles, alternatively at least about 70 moles, alternatively at least about 74 moles of the graftable acylating agent per mole of the starting polymer. The contemplated maximum molar proportion of the graftable acylating agent to the starting polymer is as follows: at most about 10 moles, alternatively at most about 12 moles, alternatively at most about 15 moles, alternatively at most about 20 moles, alternatively at most about 22 moles, alternatively at most about 24 moles, alternatively at most about 25 moles, alternatively at most about 26 moles, alternatively at most about 28 moles, alternatively at most about 30 moles, alternatively at most about 40 moles, alternatively at most about 50 moles, alternatively at most about 60 moles, alternatively at most about 74 moles of the graftable acylating agent per mole of the starting polymer.

The graftable acylating agent may be introduced into the reactor all at once, in several discrete charges, or at a steady rate over an extended period. The desired minimum rate of addition of the graftable acylating agent to the reaction mixture is selected from: at least about 0.01%, alternatively at least about 0.05%, alternatively at least about 0.1%, alternatively at least about 0.5%, alternatively at least about 1%, alternatively at least about 2%, alternatively at least about 3%, alternatively at least about 4%, alternatively at least about 5%, alternatively at least about 10%, alternatively at least about 20%, alternatively at least about 50%, alternatively at least about 100% of the necessary charge of graftable acylating agent per minute. Any of the above values can represent an average rate of addition or the minimum rate of addition. The desired maximum rate of addition is selected from: at most about 1%, alternatively at most about 2%, alternatively at most about 5%, alternatively at most about 10%, alternatively at most about 20%, alternatively at most about 50%, alternatively at most about 100% of the necessary charge of graftable acylating agent per minute. Any of the above values can represent an average rate of addition or the maximum rate of addition. When added over time, the graftable acylating agent can be added as discrete charges, at an essentially constant rate or at a rate which varies with time.

The graftable acylating agent may be added as a neat liquid, in solid or molten form, or cut back, i.e. diluted, with a solvent. While it may be introduced neat, it is preferably cut back with a solvent to avoid localized concentrations of the acylating agent as it enters the reactor. In an embodiment, it is substantially diluted with the process fluid (reaction solvent). The monomer can be diluted by at least about 5 times, alternatively at least about 10 times, alternatively at least about 20 times, alternatively at least about 50 times, alternatively at least about 100 times its weight or volume with a suitable solvent or dispersing medium.

An initiator is added to the solution comprised of polymer and acylating agent. The initiator can be added before, with or after the graftable acylating agent. When adding the initiator, it may be added all at once, in several discrete charges, or at a steady rate over an extended period. Preferably, the initiator may be added so that, at any given time, the amount of unreacted initiator present is much less than the entire charge or, more preferably, only a small fraction of the entire charge. In one embodiment, the initiator may be added after substantially, most or the entire graftable acylating agent has been added, so that there is an excess of both the graftable acylating agent and the polymer during essentially the entire reaction. In another embodiment, the initiator may be added along with, or simultaneously with, the graftable acylating agent, either at essentially the same rate (measured as a percentage of the entire charge added per minute) or at a somewhat faster or slower rate, so that there is an excess of polymer to unreacted initiator and unreacted acylating agent. For this embodiment, the ratio of unreacted initiator to unreacted acylating agent remains substantially constant during most of the reaction.

The contemplated proportions of the initiator to the graftable acylating agent and the reaction conditions are selected so that most, and preferably all, of the graftable acylating agent will graft directly onto the polymer, rather than forming dimeric, oligomeric, or homopolymeric graft moieties or entirely independent homopolymers. The contemplated minimum molar proportions of the initiator to the graftable acylating agent are from about 0.02:1 to about 2:1, alternatively from about 0.05:1 to about 2:1. No specific maximum proportion of the initiator is contemplated, though too much of the initiator may degrade the polymer, cause problems in the finished formulation and increase cost and, therefore, should be avoided.

The desired minimum rate of addition of the initiator to the reaction mixture is selected from: at least about 0.005%, alternatively at least about 0.01%, alternatively at least about 0.1%, alternatively at least about 0.5%, alternatively at least about 1%, alternatively at least about 2%, alternatively at least about 3%, alternatively at least about 4%, alternatively at least about 5%, alternatively at least about 20%, alternatively at least about 50% of the necessary charge of initiator per minute. Any of the above values can represent an average rate of addition or the minimum rate of addition. The desired maximum rate of addition of the initiator to the reaction mixture is selected from: at most about 0.5%, alternatively at most about 1%, alternatively at most about 2%, alternatively at most about 3%, alternatively at most about 4%, alternatively at most about 5%, alternatively at most about 10%, alternatively at most about 20%, alternatively at most about 50%, alternatively at most about 100% of the necessary charge of initiator per minute. Any of the above values can represent an average rate of addition or the maximum rate of addition. When the initiator is added over time, the initiator can be added as discrete charges, at an essentially constant rate or at a rate which varies with time.

While the initiator can be added neat, it is preferably cut back with a solvent to avoid high localized concentrations of the initiator as it enters the reactor. In an embodiment, it is substantially diluted with the process fluid (reaction solvent). The initiator can be diluted by at least about 5 times, alternatively at least about 10 times, alternatively at least about 20 times, alternatively at least about 50 times, alternatively at least about 100 times its weight or volume with a suitable solvent or dispersing medium.

Once the grafting of the acylating agent to the polymer has proceeded to the extent required by the particular reactants, the next step in the preparation of the graft polymer may be undertaken immediately or the solution may be stored and the next step in the preparation of the graft polymer may be undertaken at a later time.

The next step in the preparation of the graft polymer is the conversion of a percentage of the acyl groups of the acylated polymer, e.g. the succinic anhydride substituents, into the soot handling functional group via a condensation reaction with a first amine reactant or reactants. The solution may be maintained either at an elevated temperature, such as the temperature appropriate for carrying out the grafting reaction, or the temperature may be decreased to, for example, room temperature. If the reactor temperature is decreased, the amine reactant may be introduced into the reactor all at once and blended into the polymer solution. The reactor temperature is then raised to a suitable temperature to carry out the reaction between the acylated polymer and the amine reactant. Alternatively, the reactor may be maintained at an elevated temperature, in which case the amine reactant is preferably fed to the reactor relatively slowly allowing for the reaction between the acylated polymer and the amine reactant. The reactants are maintained at temperature until the reaction with the amine is substantially complete. The inert blanket may be maintained during this stage of preparation of the graft polymer.

The contemplated proportions of the first amine reactant to polymer are selected so that an effective percentage will react with the acyl group, e.g., a succinic anhydride group.

The first amine reactant may be introduced into the reactor in several (or, alternatively, many) discrete charges, or at a steady rate over an extended period, or at a rate which varies with time, or all at once. That is, the rate of addition of amine reactant is as follows: at least about 0.2%, alternatively at least about 0.5%, alternatively at least about 1%, alternatively at least about 2%, alternatively at least about 3%, alternatively at least about 4%, alternatively at least about 5%, alternatively at least about 20%, alternatively at least about 50%, alternatively at least about 100% of the necessary charge of amine reactant per minute. Any of the above values can represent an average rate of addition or the minimum value of a rate which varies with time.

The final step in the preparation of the graft polymer is the conversion of a percentage of the remaining acyl groups of the acylated polymer, e.g. the succinic anhydride substituents, into the sludge and varnish control functional group via a condensation reaction with a second amine reactant or reactants. The solution may be maintained either at an elevated temperature, such as the temperature appropriate for carrying out the previous condensation reaction, or the temperature may be decreased to, for example, room temperature. If the reactor temperature is decreased, the amine reactant may be introduced into the reactor all at once and blended into the polymer solution. The reactor temperature is then raised to a suitable temperature to carry out the reaction between the acylated polymer and the amine reactant. Alternatively, the reactor may be maintained at an elevated temperature, in which case the amine reactant is preferably fed to the reactor relatively slowly allowing for the reaction between the acylated polymer and the amine reactant. The reactants are maintained at temperature until the reaction with the amine is substantially complete. The inert blanket may be maintained during this stage of preparation of the graft polymer.

The contemplated proportions of the second amine reactant to polymer are selected so that an effective percentage will react with the acyl group, e.g., a succinic anhydride group.

The second amine reactant may be introduced into the reactor in several (or, alternatively, many) discrete charges, or at a steady rate over an extended period, or at a rate which varies with time, or all at once. That is, the rate of addition of amine reactant is as follows: at least about 0.2%, alternatively at least about 0.5%, alternatively at least about 1%, alternatively at least about 2%, alternatively at least about 3%, alternatively at least about 4%, alternatively at least about 5%, alternatively at least about 20%, alternatively at least about 50%, alternatively at least about 100% of the necessary charge of amine reactant per minute. Any of the above values can represent an average rate of addition or the minimum value of a rate which varies with time.

Preferably, the reaction between the second amine reactant and the remaining, i.e. unreacted, acyl groups of the acylated polymer is carried out so that all of the unreacted acyl groups of the acylated polymer are reacted with the second amine. Accordingly, the reaction is preferably carried out so that the graft polymer reaction product will not contain any unreacted acyl groups on the polymer backbone. Rather all of the grafted acyl groups are converted into either a functional groups associated with soot handling or a functional group associated with sludge and varnish control.

After the reaction has gone essentially to completion, the heat may be removed and the reaction product allowed to cool in the reactor with mixing or removed prior to cooling.

Preparation by Melt-Reaction

The reaction can be carried out under polymer melt reaction conditions in an extrusion reactor, a heated melt-blend reactor, a Banbury mill or other high-viscosity material blenders or mixers, for example, an extruder. (The term extruder used in this specification should be understood as being exemplary of the broader class of blenders or mixers which may be used for melt-blending according to the present invention.)

To carry out the melt reaction, it is desirable to establish suitable process design parameters for the reactive extruder to insure that the unit is capable of achieving the operating parameters and conditions needed in order to generate the desired product or products. The operating conditions and parameters appropriate for carrying out reactive extrusion include, but are not limited to, criteria for the reactant addition ports, the reactant feed systems which include feed rate controllers and monitors, the polymer feed hopper, the polymer handling and feed system which includes feed rate controllers and monitors, the extruder design which includes, among others, the screw design and its size, barrel diameter and length, die configuration and open cross-section, systems for heating the extruder and controlling extruder temperature, such as, barrel temperature and die temperature, screw speed, and both pre-extrusion and post-extrusion conditions. The precise conditions are established by those skilled in the art to meet the product targets. It should be noted that during its operation, the extruder can be maintained under, essentially, aerobic conditions, or may be purged or blanketed with an inerting material to create anaerobic operating conditions.

The appropriate reactant feed concentrations and conditions may be based upon the teachings presented in the present specification for the solvent based grafting reaction.

These include the appropriate feed rates, concentrations and conditions of the polymer or polymers, the acylating agent or agents, the initiator or initiators, and the amine reactants. Examples of the concentrations and conditions referred to include, among others, the relative concentrations of the acylating agent to both the polymer and the initiator and of the relative concentration of both the first amine reactant to the acylating agent and the second amine reactant to the acylating agent. The contemplated minimum and maximum molar proportions are, in general, the same as those previously identified for the solvent based reactions.

While the reactants may be added neat, in some embodiments, the reactants may be introduced "cut-back" or diluted with solvent in order to avoid localized regions of elevated species concentration. Representative solvents include base oils conventionally used in lubricant compositions, as defined in this specification, mineral spirits, volatile, as well as non-volatile, solvents, polar solvents and other solvents known to those skilled in the art. The concentration of reagent, relative to solvent may range from about 1 wt % to about 99 wt %. In general, the concentrations and conditions for carrying out the reaction of the acylating agent and the polymer via reactive extrusion are chosen in order to promote grafting of the acylating agent directly onto the polymer, as compared with reacting to form dimeric, oligomeric, or homopolymeric graft moieties or, even, independent homopolymers.

In carrying out the graft reaction of the acylating agent and the polymer, the polymer, essentially as a solid, is fed to the extruder at a constant rate and brought to its melt condition. The graftable acylating agent and initiator are metered into the extruder at a constant rate. This may be done either through the same feed port as that of the polymer or through specific reactant feed ports. That is, the graftable reactant and initiator may be fed, essentially together with the polymer into the same extruder zone, or alternatively, delivery of the graftable reactant and initiator may be somewhat delayed, by being introduced downstream from the polymer into a zone separated from the polymer feed hopper by appropriate screw seal elements.

With respect to the initiator, it may be introduced, either before, together with, or after the graftable acylating agent, namely, either into the same extruder zone or into different zones established by appropriate seal elements. These screw elements may be located either in front of or after the respective zones into which the graftable reactant is fed. The feed rates of graftable acylating agent and of initiator and their concentrations relative to polymer are adjusted to yield the desired product composition. In addition to the graftable acylating agent, the two different amines that are capable of reacting with the acylating agent may be fed to the extruder downstream from the grafted polymer to complete the preparation of the multi-function graft polymer.

In an embodiment, the graftable acylating agent is grafted onto the polymer via extrusion and then the amine condensation reactions are carried out in solution. Because the condensation reactions do not suffer from the same interferences from aromatics in the solvent as the free-radical graft reaction, the condensation reactions may be performed in a base oil having a higher aromatic content. Thus, in this embodiment, the multi-function graft polymer may be produced in the absence of expensive Group II base oil solvent.

The melt reaction product may be used either neat, as a "solid" or dissolved in an appropriate solvent. In an embodiment, the grafted polymer product is dissolved in an appropriate solvent of base stock in order to facilitate handling of the graft polymer and to facilitate lubricant blending using the graft product.

Lubricating Oil Compositions

The lubricating oil compositions of embodiments of the present invention may comprise the following ingredients in the stated proportions:

A. from about 60% to about 99% by weight, alternatively from about 65% to about 99% by weight, alternatively from about 70% to about 99% by weight, of one or more base oils (including base oil carried over from the making of the grafted polymer);

B. from about 0.02% solids to about 10% solids by weight, alternatively from about 0.05% solids to about 10% solids by weight, alternatively from about 0.05% solids to about 5% solids by weight, alternatively from about 0.15% solids to about 2.5% solids by weight, alternatively from about 0.15% solids to about 2% solids by weight, alternatively from 0.25% solids to about 2% solids by weight, alternatively from 0.3% solids by weight to 1.5% solids by weight, alternatively from 0.3% solids by weight to 1.0% solids by weight, alternatively from 0.4% solids by weight to 0.7% solids by weight, alternatively from 0.4% solids by weight to 0.6% solids by weight of one or more of the grafted polymers made according to this specification (i.e., not including base oil carried over from the making of the grafted polymer);

C. from 0.0% solids to 2.0% solids by weight, alternatively from about 0.0% solids to about 1.0% solids by weight, alternatively from about 0.05% solids to about 0.7% solids by weight, alternatively from about 0.1% solids to about 0.7% solids by weight, of conventional viscosity index improvers;

D. from 0.0% to about 15% by weight, alternatively from about 0.2% to about 10% by weight, alternatively from about 0.5% to about 8% by weight, or alternatively from about 0.7% to about 6%, of one or more conventional dispersants;

E. from 0.0% to about 10% by weight, alternatively from about 0.3% to 10% by weight, alternatively from about 0.3% to 8% by weight, alternatively from about 0.5% to about 6% by weight, alternatively from about 0.5 to about 4% by weight, of one or more detergents;

F. from 0.0% to about 5% by weight, alternatively from about 0.00% to 5% by weight, alternatively from about 0.01% to 5% by weight, alternatively from about 0.04% to about 3% by weight, alternatively from about 0.06% to about 2% by weight, of one or more anti-wear agents;

G. from 0.00% to 5% by weight, alternatively from about 0.01% to 5% by weight, alternatively from about 0.01% to 3% by weight, alternatively from about 0.05% to about 2.5% by weight, alternatively from about 0.1% to about 2% by weight, of one or more anti-oxidants; and H. from about 0.0% to 4% by weight, alternatively from about 0.0% to 3% by weight, alternatively from about 0.005% to about 2% by weight, alternatively from about 0.005% to about 1.5% by weight, of minor ingredients such as, but not limited to, friction modifiers, pour point depressants, and anti-foam agents.

The percentages of D through H may be calculated based on the form in which they are commercially available. The function and properties of each ingredient identified above and several examples of ingredients are summarized in the following sections of this specification.

Base Oils: Any of the petroleum or synthetic base oils previously identified as process solvents for the graftable polymers of the present invention can be used as the base oil. Indeed, any conventional lubricating oil, or combinations thereof, may also be used.

Multiple Function Grafted Polymers: The multiple function grafted polymers can be used in place of part, or all, of the viscosity index improving polymers conventionally used in such formulations. They can also be used in place of part or all of the agents used to control soot, sludge and varnish that are conventionally used in such formulations, as they possess soot handling and dispersancy properties.

Conventional Viscosity Index Improvers: The conventional viscosity index improvers can be used in the formulations. These are conventionally long-chain polyolefins. Several examples of polymers contemplated for use herein include those suggested by U.S. Pat. No. 4,092,255, the disclosure of which is incorporated herein by reference in its entirety, at column 1, lines 29-32: polyisobutenes, polymethacrylates, polyalkylstyrenes, partially hydrogenated copolymers of butadiene and styrene, amorphous polyolefins of ethylene and propylene, ethylene-propylene diene polymers, polyisoprene, and styrene-isoprene.

Conventional Dispersants: Dispersants help suspend insoluble engine oil oxidation products, thus preventing sludge flocculation and precipitation or deposition of particulates on metal parts. Suitable dispersants include alkyl succinimides such as the reaction products of oil-soluble polyisobutylene succinic anhydride with ethylene amines such as tetraethylene pentamine and borated salts thereof. Such conventional dispersants are contemplated for use herein. Several examples of dispersants include those listed in U.S. Pat. No. 4,092,255 at column 1, lines 38-41: succinimides or succinic esters, alkylated with a polyolefin of isobutene or propylene, on the carbon in the alpha position of the succinimide carbonyl. These additives are useful for maintaining the cleanliness of an engine or other machinery.

Detergents: Detergents to maintain engine cleanliness can be used in the present lubricating oil compositions. These materials include the metal salts of sulfonic acids, alkyl phenols, sulfurized alkyl phenols, alkyl salicylates, naphthenates, and other soluble mono- and dicarboxylic acids. Basic (vis, overbased) metal salts, such as basic alkaline earth metal sulfonates (especially calcium and magnesium salts) are frequently used as detergents. Such detergents are particularly useful for keeping the insoluble particulate materials in an engine or other machinery in suspension. Other examples of detergents contemplated for use herein include those recited in U.S. Pat. No. 4,092,255, at column 1, lines 35-36: sulfonates, phenates, or organic phosphates of polyvalent metals.

Anti-Wear Agents: Anti-wear agents, as their name implies, reduce wear of metal parts. Zinc dialkyldithiophosphates and zinc diaryldithiophosphates and organo molybdenum compounds such as molybdenum dialkyldithiocarbamates are representative of conventional anti-wear agents.

Anti-Oxidants: Oxidation inhibitors, or anti-oxidants, reduce the tendency of lubricating oils to deteriorate in service. This deterioration can be evidenced by increased oil viscosity and by the products of oxidation such as sludge and varnish-like deposits on the metal surfaces. Such oxidation inhibitors include alkaline earth metal salts of alkylphenolthioesters having preferably $C_5$ to $C_{12}$ alkyl side chains, e.g., calcium nonylphenol sulfide, dioctylphenylamine, phenylalpha-naphthylamine, phosphosulfurized or sulfurized hydrocarbons, and organo molybdenum compounds such as molybdenum dialkyldithiocarbamates. Use of conventional antioxidants may be reduced or eliminated by the use of the multiple function grafted polymer of the present invention.

Minor Ingredients: Many minor ingredients which do not prevent the use of the present compositions as lubricating oils are contemplated herein. A non-exhaustive list of other such additives includes pour point depressants, rust inhibitors, as well as extreme pressure additives, friction modifiers, seal swell agents, antifoam additives, and dyes.

Example 1

In a first step, a polymer polyolefin polymer backbone comprising acyl groups is prepared. To a twin screw intermeshing extruder is added EniChem CO-043 ethylene/propylene copolymer at a rate of 1300 lbs/hr. After addition of the polymer to the extruder, processing begins by the conversion of the solid polymer to a melt. Once a melt is achieved, maleic anhydride (MAH) is injected to the extruder as a liquid at a rate of 18.2 lbs/hr. Once the MAH has been fully incorporated into the melt, a peroxide DHBP is injected to the extruder at a rate of 1.80 lbs/hr. Note that the peroxide has been diluted in mineral oil at a ratio of 5:1. The dilution of the peroxide is necessary to aid in the mixing and distribution of the initiator.

The reaction mixture is further processed in the extruder to complete the reaction. The reaction is terminated by vacuum stripping of unreacted MAH, DHBP, and peroxide byproducts. The product is finished by underwater pellitization and then air dried and packaged. The resulting product is ethylene/propylene copolymer having grafted acyl groups. The grafted polymer contains about 1.40 wt % maleic anhydride.

Example 2

In a second step, the grafted polymer of Example 1 was reacted with two different amines, in sequence, to provide functional groups associated with both soot handling and sludge and varnish control. A 1000 ml glass reactor vessel with an electric heating mantle, thermometer, stirrer, and a gas inlet was charged with 500 grams of a 12.5% maleic anhydride grafted ethylene-propylene polymer solution. The solution was prepared by dissolving 62.5 grams of the grafted polymer of Example 1 in 437.5 grams of FHR-150 base stock. The gas inlet permits the gas to be fed either below or above the solution surface. The solution was heated to 170° C. and maintained at this temperature throughout the process. During heating, the polymer solution was purged with an inert gas ($CO_2$) fed below the surface of the solution. Once the solution was maintained at 170° C., the $CO_2$ was fed above the polymer solution; this blanket gas flow was maintained throughout the rest of the preparation of grafted polymer.

A solution of 20% 4-aminodiphenylamine (ADPA), obtained from Flexsys America, (#921141), and 80% triethylene glycol di-2-ethylhexoate, obtained from Hatco, #5238, was prepared. 4.10 grams of the ADPA solution was weighed out and added to the heated graft polymer solution in a single shot. The reactants were allowed to react for about one hour. After the ADPA reaction was complete, a sample of 1-(3-aminopropyl)-imidazole obtained from Sigma Aldrich (#272264) was weighed out to comprise 0.735 g grams of 1-(3-aminopropyl)-imidazole, and added in a single shot to the heated solution. The solution was allowed to react for about one hour to complete the reaction.

The reaction product contained approximately 9.4 moles of imidazole and 7.13 moles of ADPA per mole of polymer, and obtained a full conversion of maleic anhydride based on FT-IR spectra. The reaction product is further described in Table 1.

TABLE 1

| Example 2 | |
|---|---|
| Maleic Anhydride % (Solid Polymer Basis) | 1.40% |
| % Solid Polymer in Reaction | 12.50% |
| Mass % Amino-Propyl Imidazole (API) | 0.147% |
| Mass % 4-ADPA | 0.164% |
| Molecular weights and Ratios: | |
| 4-ADPA | 184 g/mol |
| API | 125 g/mol |
| CO-043 | 100000 g/mol |
| Molar Ratio API/Polymer | 9.41 |
| Molar Ratio ADPA/Polymer | 7.13 |
| Performance Testing | |
| ADT | 16 |

Example 3

The grafted polymer of Example 1 was reacted with two different amines, in sequence, to provide functional groups associated with both soot handling and sludge and varnish control.

A 1000 ml glass reactor vessel with an electric heating mantle, thermometer, stirrer, and a gas inlet was charged with 500 grams of a 12.5% maleic anhydride grafted ethylene-propylene polymer solution. The solution was prepared by dissolving 62.5 grams of the grafted polymer of Example 1 in 437.5 grams of FHR-150 base stock. The gas inlet permits the gas to be fed either below or above the solution surface. The solution was heated to 170° C. and maintained at this temperature throughout the process. During heating, the polymer solution was purged with an inert gas ($CO_2$) fed below the surface of the solution. Once the solution was maintained at 170° C., the $CO_2$ was fed above the polymer solution; this blanket gas flow was maintained throughout the rest of the preparation of grafted polymer.

A solution of 20% 4-aminodiphenylamine (ADPA), obtained from Flexsys America, (#921141), and 80% triethylene glycol di-2-ethylhexoate, obtained from Hatco, #5238, was prepared. 4.70 grams of the ADPA solution was weighed out and added to the heated graft polymer solution in a single shot. The reactants were allowed to react for about one hour. After the ADPA reaction was complete, a sample of 1-(3-aminopropyl)-imidazole obtained from Sigma Aldrich (#272264) was weighed out to comprise 0.735 g grams of 1-(3-aminopropyl)-imidazole, and added in a single shot to the heated solution. The solution was allowed to react for about one hour to complete the reaction.

Comparative Example 3

As in Example 3, the grafted polymer of Example 1 was reacted with two different amines, in sequence, to provide functional groups associated with both soot handling and sludge and varnish control. This time, however, the sequence of the reaction was reversed.

A 1000 ml glass reactor vessel with an electric heating mantle, thermometer, stirrer, and a gas inlet was charged with 500 grams of a 12.5% maleic anhydride grafted ethylene-propylene polymer solution. The solution was prepared by dissolving 62.5 grams of the grafted polymer of Example 1 in 437.5 grams of FHR-150 base stock. The gas inlet permits the gas to be fed either below or above the solution surface. The solution was heated to 170° C. and maintained at this temperature throughout the process. During heating, the polymer solution was purged with an inert gas ($CO_2$) fed below the surface of the solution. Once the solution was maintained at 170° C., the $CO_2$ was fed above the polymer solution; this blanket gas flow was maintained throughout the rest of the preparation of grafted polymer.

A sample of 1-(3-aminopropyl)-imidazole obtained from Sigma Aldrich (#272264) was weighed out to comprise 0.735 g grams of 1-(3-aminopropyl)-imidazole, and added in a single shot to the heated graft polymer solution. The solution was allowed to react for about one hour. After the API reaction was complete, a solution of 20% 4-aminodiphenylamine (ADPA), obtained from Flexsys America, (#921141), and 80% triethylene glycol di-2-ethylhexoate, obtained from Hatco, #5238, was prepared. 4.70 grams of the ADPA solution was weighed out and added to the heated solution in a single shot. The solution was allowed to react for about one hour to complete the reaction.

The reaction products of Example 3 and Comparative Example 3 were examined by FT-IR and Nitrogen Testing to determine the concentration of each functional group on each of the reaction products. The results are displayed in Table 2.

TABLE 2

| Reaction Type | Comparative Example 3 Aliphatic First | Example 3 Aromatic First | |
|---|---|---|---|
| % API in Reaction | 0.147% | 0.147% | |
| % 4-ADPA in Reaction | 0.188% | 0.188% | |
| | FT-IR Ratios | | Type (Wavelength Range) |
| API | 0.0236 | 0.0212 | Area Ratio (680-652/787-687) |
| 4-ADPA | 0.157 | 0.2672 | Max Height Ratio (1638-1566/787-687) |
| | Nitrogen Data | | |
| Total | 0.458% | 0.45% | |
| API | 0.373% | 0.24% | |
| 4-ADPA | 0.085% | 0.20% | |
| MW 4-ADPA | 184.24 | | |
| Nitrogen/4-ADPA | 2 | | |
| MW API | 125 | | |
| Nitrogen/API | 3 | | |
| MW Polymer (CO-043) | 100000 | | |
| Mole API/Mole Polymer | 8.91 | 5.81 | |
| Mole ADPA/Mole Polymer | 3.05 | 7.31 | |
| Mole ADPA/Mole API | 0.34 | 1.26 | |
| Mole Consumed MAH/Mole Polymer | 11.95 | 13.13 | |

Example 4

A 1000 ml glass reactor vessel with an electric heating mantle, thermometer, stirrer, and a gas inlet was charged with 500 grams of a 12.5% maleic anhydride grafted ethylene-propylene polymer solution. The solution was prepared by dissolving 62.5 grams of Lz7065C, (manufactured by the Lubrizol Corp., Cleveland, Ohio) grafted with 1.4% maleic anhydride in 437.5 grams of FHR-150 base stock. The gas inlet permits the gas to be fed either below or above the solution surface. The solution was heated to 170° C. and maintained at this temperature throughout the process. During heating, the polymer solution was purged with an inert gas (CO2) fed below the surface of the solution. Once the solution was maintained at 170° C., the CO2 was fed above the polymer solution; this blanket gas flow was maintained throughout the rest of the preparation of grafted polymer.

A solution of 20% 4-Aminodiphenylamine (ADPA), obtained from Flexsys America, #921141, and 80% Triethylene glycol di-2-ethylhexoate, obtained from Hatco, #5238, was prepared. This calculated out to 4.10 grams of the ADPA solution. The solution was allowed to react for 1 hour after addition of ADPA. After the ADPA reaction was complete, A sample of 1-(3-aminopropyl)-imidazole obtained from Sigma Aldrich #272264 was weighed out 0.735 g grams of 1-(3-aminopropyl)-imidazole, which was added in one shot to the heated solution. The solution was allowed to react for 1 hour to complete the reaction.

The resultant product contained approximately 9.4 moles of imidazole and 7.13 moles of ADPA per mole of polymer, and subsequently obtained full conversion of maleic anhydride with ADPA based on FT-IR spectra.

Example 5

A 1000 ml glass reactor vessel with an electric heating mantle, thermometer, stirrer, and a gas inlet was charged with 500 grams of a 12.5% maleic anhydride grafted styrene-butadiene polymer solution. The solution was prepared by dissolving 62.5 grams of Lz7408, (manufactured by the Lubrizol Corp., Cleveland, Ohio) grafted with 1.4% maleic anhydride in 437.5 grams of FHR-150 base stock. The gas inlet permits the gas to be fed either below or above the solution surface. The solution was heated to 170° C. and maintained at this temperature throughout the process. During heating, the polymer solution was purged with an inert gas (CO2) fed below the surface of the solution. Once the solution was maintained at 170° C., the CO2 was fed above the polymer solution; this blanket gas flow was maintained throughout the rest of the preparation of grafted polymer.

A solution of 20% 4-Aminodiphenylamine (ADPA), obtained from Flexsys America, #921141, and 80% Triethylene glycol di-2-ethylhexoate, obtained from Hatco, #5238, was prepared. This calculated out to 4.10 grams of the ADPA solution. The solution was allowed to react for 1 hour after addition of ADPA. After the ADPA reaction was complete, A sample of 1-(3-aminopropyl)-imidazole obtained from Sigma Aldrich #272264 was weighed out 0.735 g grams of 1-(3-aminopropyl)-imidazole, which was added in one shot to the heated solution. The solution was allowed to react for 1 hour to complete the reaction.

The resultant product contained approximately 9.4 moles of imidazole and 7.13 moles of ADPA per mole of polymer, and subsequently obtained full conversion of maleic anhydride with ADPA based on FT-IR spectra.

Example 6

A 1000 ml glass reactor vessel with an electric heating mantle, thermometer, stirrer, and a gas inlet was charged with 500 grams of a 12.5% maleic anhydride grafted styrene-isoprene polymer solution. The solution was prepared by dissolving 62.5 grams of Lz7308, (manufactured by the Lubrizol Corp., Cleveland, Ohio) grafted with 1.4% maleic anhydride in 437.5 grams of FHR-150 base stock. The gas inlet permits the gas to be fed either below or above the solution surface. The solution was heated to 170° C. and maintained at this temperature throughout the process. During heating, the polymer solution was purged with an inert gas (CO2) fed below the surface of the solution. Once the solution was maintained at 170° C., the CO2 was fed above the polymer solution; this blanket gas flow was maintained throughout the rest of the preparation of grafted polymer.

A solution of 20% 4-Aminodiphenylamine (ADPA), obtained from Flexsys America, #921141, and 80% Triethylene glycol di-2-ethylhexoate, obtained from Hatco, #5238, was prepared. This calculated out to 4.10 grams of the ADPA solution. The solution was allowed to react for 1 hour after addition of ADPA. After the ADPA reaction was complete, A sample of 1-(3-aminopropyl)-imidazole obtained from Sigma Aldrich #272264 was weighed out 0.735 g grams of 1-(3-aminopropyl)-imidazole, which was added in one shot to the heated solution. The solution was allowed to react for 1 hour to complete the reaction.

The resultant product contained approximately 9.4 moles of imidazole and 7.13 moles of ADPA per mole of polymer, and subsequently obtained full conversion of maleic anhydride with ADPA based on FT-IR spectra.

Example 7

A 1000 ml glass reactor vessel with an electric heating mantle, thermometer, stirrer, and a gas inlet was charged with 500 grams of a 12.5% maleic anhydride grafted polyalkyl-methacrylate polymer solution. The solution was prepared by dissolving 62.5 grams of Viscoplex 3-700, (manufactured by the Evonik, Corp. Horsham, Pa.) grafted with 1.4% maleic anhydride in 437.5 grams of FHR-150 base stock. The gas inlet permits the gas to be fed either below or above the solution surface. The solution was heated to 170° C. and maintained at this temperature throughout the process. During heating, the polymer solution was purged with an inert gas (CO2) fed below the surface of the solution. Once the solution was maintained at 170° C., the CO2 was fed above the polymer solution; this blanket gas flow was maintained throughout the rest of the preparation of grafted polymer.

A solution of 20% 4-Aminodiphenylamine (ADPA), obtained from Flexsys America, #921141, and 80% Triethylene glycol di-2-ethylhexoate, obtained from Hatco, #5238, was prepared. This calculated out to 4.10 grams of the ADPA solution. The solution was allowed to react for 1 hour after addition of ADPA. After the ADPA reaction was complete, A sample of 1-(3-aminopropyl)-imidazole obtained from Sigma Aldrich #272264 was weighed out 0.735 g grams of 1-(3-aminopropyl)-imidazole, which was added in one shot to the heated solution. The solution was allowed to react for 1 hour to complete the reaction.

The resultant product contained approximately 9.4 moles of imidazole and 7.13 moles of ADPA per mole of polymer, and subsequently obtained full conversion of maleic anhydride with ADPA based on FT-IR spectra.

Examples 8 to 115

The procedure of Examples 4 to 7 was carried out using a number of different polymers, acylating agents, amines suitable for imparting soot handling performance, and amines suitable for imparting sludge and varnish control.

As noted, polymers contemplated for use include

A1. Paratone 8910
A2. Paratone 8941
A3. Infineum SV200,
A4. Infineum SV250,
A5. Infineum SV145,
A6. Infineum SV160,
A7. Infineum SV300
A8. Infineum SV150,
A9. DUTRAL CO-029,
A10. DUTRAL CO-034,
A11. DUTRAL CO-043,
A12. DUTRAL CO-058,
A13. DUTRAL TER 4028,
A14. DUTRAL TER 4044,
A15. DUTRAL TER 4049
A16. DUTRAL TER 9046.
A17. ROYALENE 400,
A18. ROYALENE 501,
A19. ROYALENE 505,
A20. ROYALENE 512,
A21. ROYALENE 525,
A22. ROYALENE 535,
A23. ROYALENE 556,
A24. ROYALENE 563,
A25. ROYALENE 580 HT
A26. Lubrizol®7408
A27. Viscoplex 3-700
A28. Viscoplex 2-602

As noted, suitable acylating agents include

B1. acrylic acid,
B2. crotonic acid,
B3. methacrylic acid,
B4. maleic acid,
B5. maleic anhydride,
B6. fumaric acid,
B7. itaconic acid,
B8. itaconic anhydride,
B9. citraconic acid,
B10. citraconic anhydride,
B11. mesaconic acid,
B12. glutaconic acid,
B13. chloromaleic acid,
B14. aconitic acid,
B15. methylcrotonic acid,
B16. sorbic acid,
B17. 3-hexenoic acid,
B18. 10-decenoic acid,
B19. 2-pentene-1,3,5-tricarboxylic acid,
B20. cinnamic acid
B21. methyl maleate,
B22. ethyl fumarate,
B23. methyl fumarate As noted, amines suitable for imparting soot handling performance include C1. aniline;
C2. N,N-dimethyl-p-phenylenediamine;
C3. 1-naphthylamine;
C4. N-phenyl-p-phenylenediamine
C5. m-anisidine;
C6. 3-amino-4-methylpyridine;
C7. 4-nitroaniline As noted, amines suitable for imparting sludge and varnish control performance include D1. 2,2-dimethyl-1,3-dioxolane-4-methanamine;
D2. N-(3-aminopropyl) imidazole;
D3. N-(3-aminopropyl)-2-pyrrolidinone;
D4. 2-picolylamine

| Example No. | Polymer | Acylating agent | First amine | Second amine |
|---|---|---|---|---|
| 8 | A11 | B4 | C1 | D1 |
| 9 | A11 | B4 | C1 | D2 |
| 10 | A11 | B4 | C1 | D3 |
| 11 | A11 | B4 | C1 | D4 |
| 12 | A11 | B5 | C1 | D1 |
| 13 | A11 | B5 | C1 | D2 |
| 14 | A11 | B5 | C1 | D3 |
| 15 | A11 | B5 | C1 | D4 |
| 16 | A11 | B6 | C1 | D1 |
| 17 | A11 | B6 | C1 | D2 |
| 18 | A11 | B6 | C1 | D3 |
| 19 | A11 | B6 | C1 | D4 |
| 20 | A11 | B4 | C2 | D1 |
| 21 | A11 | B4 | C2 | D2 |
| 22 | A11 | B4 | C2 | D3 |
| 23 | A11 | B4 | C2 | D4 |
| 24 | A11 | B5 | C2 | D1 |
| 25 | A11 | B5 | C2 | D2 |
| 26 | A11 | B5 | C2 | D3 |
| 27 | A11 | B5 | C2 | D4 |
| 28 | A11 | B6 | C2 | D1 |
| 29 | A11 | B6 | C2 | D2 |
| 30 | A11 | B6 | C2 | D3 |
| 31 | A11 | B6 | C2 | D4 |
| 32 | A11 | B4 | C6 | D1 |
| 33 | A11 | B4 | C6 | D2 |
| 34 | A11 | B4 | C6 | D3 |
| 35 | A11 | B4 | C6 | D4 |
| 36 | A11 | B5 | C6 | D1 |
| 37 | A11 | B5 | C2 | D2 |
| 38 | A11 | B5 | C6 | D3 |
| 39 | A11 | B5 | C6 | D4 |
| 40 | A11 | B6 | C6 | D1 |
| 41 | A11 | B6 | C6 | D2 |
| 42 | A11 | B6 | C6 | D3 |
| 43 | A11 | B6 | C6 | D4 |
| 44 | A26 | B4 | C1 | D1 |
| 45 | A26 | B4 | C1 | D2 |
| 46 | A26 | B4 | C1 | D3 |
| 47 | A26 | B4 | C1 | D4 |
| 48 | A26 | B5 | C1 | D1 |
| 49 | A26 | B5 | C1 | D2 |
| 50 | A26 | B5 | C1 | D3 |
| 51 | A26 | B5 | C1 | D4 |
| 52 | A26 | B6 | C1 | D1 |
| 53 | A26 | B6 | C1 | D2 |
| 54 | A26 | B6 | C1 | D3 |
| 55 | A26 | B6 | C1 | D4 |
| 56 | A26 | B4 | C2 | D1 |
| 57 | A26 | B4 | C2 | D2 |
| 58 | A26 | B4 | C2 | D3 |
| 59 | A26 | B4 | C2 | D4 |
| 60 | A26 | B5 | C2 | D1 |
| 61 | A26 | B5 | C2 | D2 |
| 62 | A26 | B5 | C2 | D3 |
| 63 | A26 | B5 | C2 | D4 |
| 64 | A26 | B6 | C2 | D1 |
| 65 | A26 | B6 | C2 | D2 |
| 66 | A26 | B6 | C2 | D3 |
| 67 | A26 | B6 | C2 | D4 |
| 68 | A26 | B4 | C6 | D1 |
| 69 | A26 | B4 | C6 | D2 |
| 70 | A26 | B4 | C6 | D3 |
| 71 | A26 | B4 | C6 | D4 |
| 72 | A26 | B5 | C6 | D1 |
| 73 | A26 | B5 | C2 | D2 |
| 74 | A26 | B5 | C6 | D3 |
| 75 | A26 | B5 | C6 | D4 |
| 76 | A26 | B6 | C6 | D1 |
| 77 | A26 | B6 | C6 | D2 |

-continued

| Example No. | Polymer | Acylating agent | First amine | Second amine |
|---|---|---|---|---|
| 78 | A26 | B6 | C6 | D3 |
| 79 | A26 | B6 | C6 | D4 |
| 80 | A27 | B4 | C1 | D1 |
| 81 | A27 | B4 | C1 | D2 |
| 82 | A27 | B4 | C1 | D3 |
| 83 | A27 | B4 | C1 | D4 |
| 84 | A27 | B5 | C1 | D1 |
| 85 | A27 | B5 | C1 | D2 |
| 86 | A27 | B5 | C1 | D3 |
| 87 | A27 | B5 | C1 | D4 |
| 88 | A27 | B6 | C1 | D1 |
| 89 | A27 | B6 | C1 | D2 |
| 90 | A27 | B6 | C1 | D3 |
| 91 | A27 | B6 | C1 | D4 |
| 92 | A27 | B4 | C2 | D1 |
| 93 | A27 | B4 | C2 | D2 |
| 94 | A27 | B4 | C2 | D3 |
| 95 | A27 | B4 | C2 | D4 |
| 96 | A27 | B5 | C2 | D1 |
| 97 | A27 | B5 | C2 | D2 |
| 98 | A27 | B5 | C2 | D3 |
| 99 | A27 | B5 | C2 | D4 |
| 100 | A27 | B6 | C2 | D1 |
| 101 | A27 | B6 | C2 | D2 |
| 102 | A27 | B6 | C2 | D3 |
| 103 | A27 | B6 | C2 | D4 |
| 104 | A27 | B4 | C6 | D1 |
| 105 | A27 | B4 | C6 | D2 |
| 106 | A27 | B4 | C6 | D3 |
| 107 | A27 | B4 | C6 | D4 |
| 108 | A27 | B5 | C6 | D1 |
| 109 | A27 | B5 | C2 | D2 |
| 110 | A27 | B5 | C6 | D3 |
| 111 | A27 | B5 | C6 | D4 |
| 112 | A27 | B6 | C6 | D1 |
| 113 | A27 | B6 | C6 | D2 |
| 114 | A27 | B6 | C6 | D3 |
| 115 | A27 | B6 | C6 | D4 |

ADT Testing

The ADT test is used to determine the capacity of a graft polymer to disperse sludge in a typical mineral oil.

In summary, the ADT test is carried out as follows: A sample of the graft polymer is dissolved in Exxon 130N base oil to give a solution containing 0.25% weight of graft polymer solids. Separately, 10 ml of Exxon 130N base oil is put into each of a series of six test tubes in a test tube rack. 10 ml of the graft polymer solution is then added to the base oil in the first test tube in the series. The base oil and graft polymer solution in the first test tube are mixed until homogeneous, giving a solution which contains one half of the concentration of graft polymer contained in the original solution. From this first tube, 10 ml are decanted and poured into the second tube. The contents of the second tube are further diluted by a factor of 2. This process of sequential dilution is continued through the series of tubes, successively producing solutions with 1/4, 1/8, 1/16, and 1/32 of the concentration of graft polymer contained in the first tube.

A standardized quantity of sludge solution, simulating the sludge in the crankcase of an internal combustion engine, is introduced and mixed well in each of the above prepared solutions. The tubes are allowed to stand at room temperature for 24 hours (or, in some cases, for a shorter or longer period, as indicated in the test results). The tubes of each set are examined in front of a light source to determine which tube is the first in the series to exhibit sediment (fallout), this being associated with sludge which is not successfully dispersed. The ADT result is graded as follows:

| Number of Tubes with no sediment | First fallout in tube number | ADT Result |
|---|---|---|
| 0 | 1 | FAIL |
| 1 | 2 | 1 |
| 2 | 3 | 2 |
| 3 | 4 | 4 |
| 4 | 5 | 8 |
| 5 | 6 | 16 |
| 6 | — | 32 |

The ADT result is reported to the nearest power of two because the concentration of the grafted dispersant polyolefin solution is halved in each successive tube.

The Rapid ADT test is an accelerated version of the ADT test method described above. The test is carried out as described for the 24-hour test, except that the test tubes are initially kept in an oven for 90 minutes at 60° C. The tubes are graded in the same manner as before to determine the rapid ADT value of the graft polymer solution. After this accelerated test, the tubes can be maintained for an additional 24 and 48 hours at room temperature to record longer-term results.

A dispersant viscosity index improver having a higher ADT value would be able to disperse the insoluble material in a lubricating oil composition when less of the dispersant is used in the oil. Thus, a dispersant viscosity index improver having a higher ADT value would be a better dispersant than one having a lower ADT value.

Since the ADT Test evaluates the capacity of a graft polymer to disperse sludge, the compositional variable of primary importance is the concentration of the "sludge control" functional group, the reaction product between the aliphatic amine and the acylated polymer. The amount, or concentration, of the "sludge control" functional group is effective to provide a multiple function dispersant viscosity index improver that has a high ADT response.

The multiple function dispersant viscosity index improvers of embodiments of the present invention preferably have a Rapid ADT response of at least about 2. The multiple function dispersant viscosity index improvers of embodiments of the present invention more preferably have a Rapid ADT response of at least about 4. The multiple function dispersant viscosity index improvers of embodiments of the present invention more preferably have a Rapid ADT response of at least about 8. The multiple function dispersant viscosity index improvers of embodiments of the present invention more preferably have a Rapid ADT response of at least about 16. The multiple function dispersant viscosity index improvers of embodiments of the present invention more preferably have a Rapid ADT response of at least about 32.

The multiple function dispersant viscosity index improvers of embodiments of the present invention may have a Rapid ADT response between about 2 and 32. Alternatively, the multiple function dispersant viscosity index improvers of embodiments of the present invention have a Rapid ADT response between about 4 and 32. Alternatively, the multiple function dispersant viscosity index improvers of embodiments of the present invention have a Rapid ADT response between about 8 and 32. Alternatively, the multiple function dispersant viscosity index improvers of embodiments of the present invention have a Rapid ADT response between about 16 and 32.

Sequence VG Engine Test

To confirm that the dual-monomer graft polymer of the present invention is capable of controlling sludge and varnish, blended oils are being tested using the Sequence VG Engine Test. This engine test is designed to evaluate how well an engine oil inhibits sludge and varnish formation. The test is carried out using a Ford 4.6 liter, spark ignition, four stroke, eight-cylinder V-configuration engine. The test is carried out for a total of 216 hours. The test procedure calls for oil leveling and sampling every 24 hours. At the end of the test, the engine parts are rated, with respect to engine cleanliness, in terms of sludge and varnish. The performance targets for the various test parameters evaluated in the Sequence VG Engine Test, listed in Table 2, represent either maximum or minimum values.

Since the Sequence VG Engine Test evaluates the capacity of a lubricating oil additive to control sludge and varnish, the compositional variable of primary importance is the concentration of the "sludge and varnish control" functional group, i.e. the reaction product between the aliphatic amine and the acylated polymer. The aliphatic amine, and hence the "sludge and varnish control" functional group, is selected so as to be effective to provide a multiple function dispersant viscosity index improver that, when present in reasonable amounts in a base oil, produces a passing result in a Sequence VG Engine Test.

Further, the amount of the "sludge and varnish control" functional group that is grafted to the polymer backbone, i.e. the concentration of the "sludge and varnish control" functional group, is effective to provide a multiple function dispersant viscosity index improver that, when present in reasonable amounts in base oil, produces a passing result in a Sequence VG Engine Test.

For example, the multiple function dispersant viscosity index improver, when present in base oil in an amount of about 0.05% solids by weight or below, produces a passing result in a Sequence VG Engine Test. Alternatively, the multiple function dispersant viscosity index improver, when present in base oil in an amount of about 0.10% solids by weight or below, produces a passing result in a Sequence VG Engine Test. Alternatively, the multiple function dispersant viscosity index improver, when present in base oil in an amount of about 0.15% solids by weight or below, produces a passing result in a Sequence VG Engine Test. Alternatively, the multiple function dispersant viscosity index improver, when present in base oil in an amount of about 0.20% solids by weight or below, produces a passing result in a Sequence VG Engine Test. Alternatively, the multiple function dispersant viscosity index improver, when present in base oil in an amount of about 0.25% solids by weight or below, produces a passing result in a Sequence VG Engine Test. Alternatively, the multiple function dispersant viscosity index improver, when present in base oil in an amount of about 0.30% solids by weight or below, produces a passing result in a Sequence VG Engine Test. Alternatively, the multiple function dispersant viscosity index improver, when present in base oil in an amount of about 0.35% solids by weight or below, produces a passing result in a Sequence VG Engine Test. Alternatively, the multiple function dispersant viscosity index improver, when present in base oil in an amount of about 0.40% solids by weight or below, produces a passing result in a Sequence VG Engine Test. Alternatively, the multiple function dispersant viscosity index improver, when present in base oil in an amount of about 0.45% solids by weight or below, produces a passing result in a Sequence VG Engine Test. Alternatively, the multiple function dispersant viscosity index improver, when present in base oil in an amount of about 0.50% solids by weight or below, produces a passing result in a Sequence VG Engine Test. Alternatively, the multiple function dispersant viscosity index improver, when present in base oil in an amount of about 0.55% solids by weight or below, produces a passing result in a Sequence VG Engine Test. Alternatively, the multiple function dispersant viscosity index improver, when present in base oil in an amount of about 0.60% solids by weight or below, produces a passing result in a Sequence VG Engine Test. Alternatively, the multiple function dispersant viscosity index improver, when present in base oil in an amount of about 0.65% solids by weight or below, produces a passing result in a Sequence VG Engine Test. Alternatively, the multiple function dispersant viscosity index improver, when present in base oil in an amount of about 0.70% solids by weight or below, produces a passing result in a Sequence VG Engine Test. Alternatively, the multiple function dispersant viscosity index improver, when present in base oil in an amount of about 0.80% solids by weight or below, produces a passing result in a Sequence VG Engine Test. Alternatively, the multiple function dispersant viscosity index improver, when present in base oil in an amount of about 0.90% solids by weight or below, produces a passing result in a Sequence VG Engine Test. Alternatively, the multiple function dispersant viscosity index improver, when present in base oil in an amount of about 1.0% solids by weight or below, produces a passing result in a Sequence VG Engine Test. Alternatively, the multiple function dispersant viscosity index improver, when present in base oil in an amount of about 1.5% solids by weight or below, produces a passing result in a Sequence VG Engine Test. Alternatively, the multiple function dispersant viscosity index improver, when present in base oil in an amount of about 2.0% solids by weight or below, produces a passing result in a Sequence VG Engine Test. Alternatively, the multiple function dispersant viscosity index improver, when present in base oil in an amount of about 2.5% solids by weight or below, produces a passing result in a Sequence VG Engine Test. Alternatively, the multiple function dispersant viscosity index improver, when present in base oil in an amount of about 3.0% solids by weight or below, produces a passing result in a Sequence VG Engine Test. Preferably, the multiple function dispersant viscosity index improver, when present in base oil in an amount between 0.4 and 0.7% solids by weight, produces a passing result in a Sequence VG Engine Test.

In some embodiments, it might be that a multiple function dispersant viscosity index improver, when used in a particular amount in base oil, does not pass the entirety of the Sequence VG Engine Test, but nevertheless demonstrates either strong sludge control properties or strong varnish control properties.

For example, the multiple function dispersant viscosity index improver, when present in base oil in an amount of about 0.05% solids by weight or below, produces an Average Engine Sludge, as measured via a Sequence VG Engine Test, of at least 8. Alternatively, the multiple function dispersant viscosity index improver, when present in base oil in an amount of about 0.10% solids by weight or below, produces an Average Engine Sludge, as measured via a Sequence VG Engine Test, of at least 8. Alternatively, the multiple function dispersant viscosity index improver, when present in base oil in an amount of about 0.15% solids by weight or below, produces an Average Engine Sludge, as measured via a Sequence VG Engine Test, of at least 8. Alternatively, the multiple function dispersant viscosity index improver, when present in base oil in an amount of about 0.20% solids by weight or below, produces an Average Engine Sludge, as measured via a Sequence VG Engine Test, of at least 8. Alternatively, the multiple function dispersant viscosity index improver, when present in base oil in an amount of about 0.25% solids by weight or below, produces an Average Engine Sludge, as measured via a Sequence VG Engine Test, of at least 8. Alternatively, the multiple function dispersant viscosity index improver, when present in base oil in an amount of about 0.30% solids by weight or below, produces an Average Engine Sludge, as measured via a Sequence VG Engine Test, of at least 8. Alternatively, the multiple function dispersant viscosity index improver, when present in base oil in an amount of about 0.35% solids by weight or below, produces an Average Engine Sludge, as measured via a Sequence VG Engine Test, of at least 8. Alternatively, the multiple function dispersant viscosity index improver, when present in base oil in an amount of about 0.40% solids by weight or below, produces an Average Engine Sludge, as measured via a Sequence VG Engine Test, of at least 8. Alternatively, the multiple function dispersant viscosity index improver, when present in base oil in an amount of about 0.45% solids by weight or below, produces an Average Engine Sludge, as measured via a Sequence VG Engine Test, of at least 8. Alternatively, the multiple function dispersant viscosity index improver, when present in base oil in an amount of about 0.50% solids by weight or below, produces an Average Engine Sludge, as measured via a Sequence VG Engine Test, of at least 8. Alternatively, the multiple function dispersant viscosity index improver, when present in base oil in an amount of about 0.55% solids by weight or below, produces an Average Engine Sludge, as measured via a Sequence VG Engine Test, of at least 8. Alternatively, the multiple function dispersant viscosity index improver, when present in base oil in an amount of about 0.60% solids by weight or below, produces an Average Engine Sludge, as measured via a Sequence VG Engine Test, of at least 8. Alternatively, the multiple function dispersant viscosity index improver, when present in base oil in an amount of about 0.65% solids by weight or below, produces an Average Engine Sludge, as measured via a Sequence VG Engine Test, of at least 8. Alternatively, the multiple function dispersant viscosity index improver, when present in base oil in an amount of about 0.70% solids by weight or below, produces an Average Engine Sludge, as measured via a Sequence VG Engine Test, of at least 8. Alternatively, the multiple function dispersant viscosity index improver, when present in base oil in an amount of about 0.80% solids by weight or below, produces an Average Engine Sludge, as measured via a Sequence VG Engine Test, of at least 8. Alternatively, the multiple function dispersant viscosity index improver, when present in base oil in an amount of about 0.90% solids by weight or below, produces an Average Engine Sludge, as measured via a Sequence VG Engine Test, of at least 8. Alternatively, the multiple function dispersant viscosity index improver, when present in base oil in an amount of about 1.0% solids by weight or below, produces an Average Engine Sludge, as measured via a Sequence VG Engine Test, of at least 8. Alternatively, the multiple function dispersant viscosity index improver, when present in base oil in an amount of about 1.5% solids by weight or below, produces an Average Engine Sludge, as measured via a Sequence VG Engine Test, of at least 8. Alternatively, the multiple function dispersant viscosity index improver, when present in base oil in an amount of about 2.0% solids by weight or below, produces an Average Engine Sludge, as measured via a Sequence VG Engine Test, of at least 8. Alternatively, the multiple function dispersant viscosity index improver, when present in base oil in an amount of about 2.5% solids by weight or below, produces an Average Engine Sludge, as measured via a Sequence VG Engine Test, of at least 8. Alternatively, the multiple function dispersant viscosity index improver, when present in base oil in an amount of about 3.0% solids by weight or below, produces an Average Engine Sludge, as measured via a Sequence VG Engine Test, of at least 8. In an embodiment, the multiple function dispersant viscosity index improver, when present in base oil in an amount between 0.4 and 0.7% solids by weight, produces an Average Engine Sludge, as measured via a Sequence VG Engine Test, of at least 8.

For example, the multiple function dispersant viscosity index improver, when present in base oil in an amount of about 0.05% solids by weight or below, produces an Average Engine Varnish, as measured via a Sequence VG Engine Test, of at least 8.9. Alternatively, the multiple function dispersant viscosity index improver, when present in base oil in an amount of about 0.10% solids by weight or below, produces an Average Engine Varnish, as measured via a Sequence VG Engine Test, of at least 8.9. Alternatively, the multiple function dispersant viscosity index improver, when present in base oil in an amount of about 0.15% solids by weight or below, produces an Average Engine Varnish, as measured via a Sequence VG Engine Test, of at least 8.9. Alternatively, the multiple function dispersant viscosity index improver, when present in base oil in an amount of about 0.20% solids by weight or below, produces an Average Engine Varnish, as measured via a Sequence VG Engine Test, of at least 8.9. Alternatively, the multiple function dispersant viscosity index improver, when present in base oil in an amount of about 0.25% solids by weight or below, produces an Average Engine Varnish, as measured via a Sequence VG Engine Test, of at least 8.9. Alternatively, the multiple function dispersant viscosity index improver, when present in base oil in an amount of about 0.30% solids by weight or below, produces an Average Engine Varnish, as measured via a Sequence VG Engine Test, of at least 8.9. Alternatively, the multiple function dispersant viscosity index improver, when present in base oil in an amount of about 0.35% solids by weight or below, produces an Average Engine Varnish, as measured via a Sequence VG Engine Test, of at least 8.9. Alternatively, the multiple function dispersant viscosity index improver, when present in base oil in an amount of about 0.40% solids by weight or below, produces an Average Engine Varnish, as measured via a Sequence VG Engine Test, of at least 8.9. Alternatively, the multiple function dispersant viscosity index improver, when present in base oil in an amount of about 0.45% solids by weight or below, produces an Average Engine Varnish, as measured via a Sequence VG Engine Test, of at least 8.9. Alternatively, the multiple function dispersant viscosity index improver, when present in base oil in an amount of about 0.50% solids by weight or below, produces an Average Engine Varnish, as measured via a Sequence VG Engine Test, of at least 8.9. Alternatively, the multiple function dispersant viscosity index improver, when present in base oil in an amount of about 0.55% solids by weight or below, produces an Average Engine Varnish, as measured via a Sequence VG Engine Test, of at least 8.9. Alternatively, the multiple function dispersant viscosity index improver, when present in base oil in an amount of about 0.60% solids by weight or below, produces an Average Engine Varnish, as measured via a Sequence VG Engine Test, of at least 8.9. Alternatively, the multiple function dispersant viscosity index improver, when present in base oil in an amount of about 0.65% solids by weight or below, produces an Average Engine Varnish, as measured via a Sequence VG Engine Test, of at least 8.9. Alternatively, the multiple function dispersant viscosity index improver, when present in base oil in an amount of about 0.70% solids by weight or below, produces an Average Engine Varnish, as measured via a Sequence VG Engine Test, of at least 8.9. Alternatively, the multiple function dispersant viscosity index improver, when present in base oil in an amount of about 0.80% solids by weight or below, produces an Average Engine Varnish, as measured via a Sequence VG Engine Test, of at least 8.9. Alternatively, the multiple function dispersant viscosity index improver, when present in base oil in an amount of about 0.90% solids by weight or below, produces an Average Engine Varnish, as measured via a Sequence VG Engine Test, of at least 8.9. Alternatively, the multiple function dispersant viscosity index improver, when present in base oil in an amount of about 1.0% solids by weight or below, produces an Average Engine Varnish, as measured via a Sequence VG Engine Test, of at least 8.9. Alternatively, the multiple function dispersant viscosity index improver, when present in base oil in an amount of about 1.5% solids by weight or below, produces an Average Engine Varnish, as measured via a Sequence VG Engine Test, of at least 8.9. Alternatively, the multiple function dispersant viscosity index improver, when present in base oil in an amount of about 2.0% solids by weight or below, produces an Average Engine Varnish, as measured via a Sequence VG Engine Test, of at least 8.9. Alternatively, the multiple function dispersant viscosity index improver, when present in base oil in an amount of about 2.5% solids by weight or below, produces an Average Engine Varnish, as measured via a Sequence VG Engine Test, of at least 8.9. Alternatively, the multiple function dispersant viscosity index improver, when present in base oil in an amount of about 3.0% solids by weight or below, produces an Average Engine Varnish, as measured via a Sequence VG Engine Test, of at least 8.9. In one embodiment, the multiple function dispersant viscosity index improver, when present in base oil in an amount between 0.4 and 0.7% solids by weight, produces an Average Engine Varnish, as measured via a Sequence VG Engine Test, of at least 8.9.

To confirm that the multiple function dispersant viscosity index improver is capable of controlling sludge and varnish, two engine oils were blended and tested using the Sequence VG Engine Test, a test, as noted, designed to evaluate an oil's ability to control sludge and varnish. The first oil—the baseline oil—contained a conventional dispersant viscosity modifier. The composition of the baseline oil is shown in Table 3, below. The second oil—the test oil—was blended so as to contain the multiple function dispersant viscosity index improver prepared in Example 2. The multiple function dispersant viscosity index improver is present in the second oil blend in an amount of about 0.5% solids by weight. The composition of the test oil is shown in Table 4, below.

TABLE 3

Baseline Oil

| Component | Type of Material | % Weight |
|---|---|---|
| Motiva Star 4 | Base oil 1 | 10.00% |
| Motiva Star 6 | Base oil 2 | 34.69% |
| Yubase 4 | Base oil 3 | 40.00% |
| 902D | Previous Generation Proprietary DVM | 4.76% |
| CA 4400 | Viscosity Modifier | 3.60% |
| LZ 20037 | Additive Package | 6.700% |
| RH1-3009 | Pour Point Depressant | 0.25% |
| Total: | | 100.000% |

TABLE 4

Oil w/Reaction Product of Example 2

| Component | Type of Material | % Weight |
|---|---|---|
| Motiva Star 4 | Base oil 1 | 10.00% |
| Motiva Star 6 | Base oil 2 | 33.39% |
| Yubase 4 | Base oil 3 | 40.00% |
| Product of Example 2 | Multi-Function DVM | 6.06% |
| CA 4400 | Viscosity Modifier | 3.60% |
| LZ 20037 | Additive Package | 6.700% |
| RH1-3009 | Pour Point Depressant | 0.25% |
| Total: | | 100.000% |

The results of the Sequence VG Engine Test are shown in Table 5. The performance targets, i.e. passing limits, for the various test parameters evaluated in the Sequence VG Engine Test, listed in Table 5, represent either maximum or minimum values. Hence, an Average Engine Sludge of 7.25 for the Baseline Oil is a failing result since the minimum requirements for passing the test is 8. The Baseline Oil also failed to meet the minimum requirement for the Rocker Arm Cover Sludge test parameter. The lubricating oil composition comprising the multiple function dispersant viscosity index improver prepared in Example 2 met every performance target of the Sequence VG test, including Average Engine Sludge and Average Engine Varnish.

TABLE 5

Sequence VG Engine Test Results

| | Baseline Oil | Oil + product of Example 2 | Passing Limits |
|---|---|---|---|
| Average Engine Sludge | 7.25 | 8.79 | 8 min |
| Rocker Arm Cover Sludge | 7.80 | 8.71 | 8.3 min |
| Average Piston Skirt Varnish | 7.97 | 8.35 | 7.5 min |
| Average Engine Varnish | 9.08 | 9.24 | 8.9 min |
| Oil Screen Clogging, % | 15 | 4 | 15 max |
| Hot Stuck Compression Rings | 0 | 0 | 0 max |
| Performance Assessment | FAIL | PASS | |

Peugeot XUD 11 Screener Engine Test

The capability of the multiple function dispersant viscosity index improver to control soot and viscosity increase may be demonstrated using the Peugeot XUD11 Screener Engine Test. The Peugeot XUD 11 Screener Engine Test is a test designed to evaluate the influence of combustion soot on engine oil performance at medium temperatures with emphasis upon soot induced engine oil viscosity increase.

It is carried out using a Peugeot XUD11 BTE 2.1 liter, inline, four-cylinder turbocharged automotive diesel engine. The engine test is run for approximately 20-25 hours with oil additions made and oil samples collected approximately every 5 hours. The following parameters are measured: soot loading (or soot suspended) in the oil at the end of the test, viscosity increase at 100° C. at the end of test, and the extrapolated viscosity increase at 100° C. at a soot loading of 3%. Relative improvement in performance is indicated by a relative increase in the percentage of soot in the oil and by relative decreases in both the end of test viscosity and the viscosity increase extrapolated to 3% soot.

Since the Peugeot XUD11 Screener Engine Test evaluates soot handling and viscosity control, the compositional variable of primary importance is the concentration of the "soot handling" functional group, the reaction product between the aromatic amine and the acylated polymer. The aromatic amine, and hence the "soot handling" functional group, is selected so as to be effective to provide a multiple function dispersant viscosity index improver that, when present in reasonable amounts in a base oil, produces a passing result in the Peugeot XUD11 Screener Engine Test. The amount of the "soot handling" functional group that is grafted to the polymer backbone, i.e. the concentration of the "soot handling" functional group, is preferably effective to provide a multiple function dispersant viscosity index improver that, when present in reasonable amounts in base oil, produces a passing result in the Peugeot XUD11 Screener Engine Test.

For example, the multiple function dispersant viscosity index improver, when present in base oil in an amount of about 0.05% solids by weight or below, produces a passing result in a Peugeot XUD11 Screener Engine Test. Alternatively, the multiple function dispersant viscosity index improver, when present in base oil in an amount of about 0.10% solids by weight or below, produces a passing result in a Peugeot XUD11 Screener Engine Test. Alternatively, the multiple function dispersant viscosity index improver, when present in base oil in an amount of about 0.15% solids by weight or below, produces a passing result in a Peugeot XUD11 Screener Engine Test. Alternatively, the multiple function dispersant viscosity index improver, when present in base oil in an amount of about 0.20% solids by weight or below, produces a passing result in a Peugeot XUD11 Screener Engine Test. Alternatively, the multiple function dispersant viscosity index improver, when present in base oil in an amount of about 0.25% solids by weight or below, produces a passing result in a Peugeot XUD11 Screener Engine Test. Alternatively, the multiple function dispersant viscosity index improver, when present in base oil in an amount of about 0.30% solids by weight or below, produces a passing result in a Peugeot XUD11 Screener Engine Test. Alternatively, the multiple function dispersant viscosity index improver, when present in base oil in an amount of about 0.35% solids by weight or below, produces a passing result in a Peugeot XUD11 Screener Engine Test. Alternatively, the multiple function dispersant viscosity index improver, when present in base oil in an amount of about 0.40% solids by weight or below, produces a passing result in a Peugeot XUD11 Screener Engine Test. Alternatively, the multiple function dispersant viscosity index improver, when present in base oil in an amount of about 0.45% solids by weight or below, produces a passing result in a Peugeot XUD11 Screener Engine Test. Alternatively, the multiple function dispersant viscosity index improver, when present in base oil in an amount of about 0.50% solids by weight or below, produces a passing result in a Peugeot XUD11 Screener Engine Test. Alternatively, the multiple function dispersant viscosity index improver, when present in base oil in an amount of about 0.55% solids by weight or below, produces a passing result in a Peugeot XUD11 Screener Engine Test. Alternatively, the multiple function dispersant viscosity index improver, when present in base oil in an amount of about 0.60% solids by weight or below, produces a passing result in a Peugeot XUD11 Screener Engine Test. Alternatively, the multiple function dispersant viscosity index improver, when present in base oil in an amount of about 0.65% solids by weight or below, produces a passing result in a Peugeot XUD11 Screener Engine Test. Alternatively, the multiple function dispersant viscosity index improver, when present in base oil in an amount of about 0.70% solids by weight or below, produces a passing result in a Peugeot XUD11 Screener Engine Test. Alternatively, the multiple function dispersant viscosity index improver, when present in base oil in an amount of about 0.80% solids by weight or below, produces a passing result in a Peugeot XUD11 Screener Engine Test. Alternatively, the multiple function dispersant viscosity index improver, when present in base oil in an amount of about 0.90% solids by weight or below, produces a passing result in a Peugeot XUD11 Screener Engine Test. Alternatively, the multiple function dispersant viscosity index improver, when present in base oil in an amount of about 1.0% solids by weight or below, produces a passing result in a Peugeot XUD11 Screener Engine Test. Alternatively, the multiple function dispersant viscosity index improver, when present in base oil in an amount of about 1.5% solids by weight or below, produces a passing result in a Peugeot XUD11 Screener Engine Test. Alternatively, the multiple function dispersant viscosity index improver, when present in base oil in an amount of about 2.0% solids by weight or below, produces a passing result in a Peugeot XUD11 Screener Engine Test. Alternatively, the multiple function dispersant viscosity index improver, when present in base oil in an amount of about 2.5% solids by weight or below, produces a passing result in a Peugeot XUD11 Screener Engine Test. Alternatively, the multiple function dispersant viscosity index improver, when present in base oil in an amount of about 3.0% solids by weight or below, produces a passing result in a Peugeot XUD11 Screener Engine Test. In one embodiment, the multiple function dispersant viscosity index improver, when present in base oil in an amount between 0.4 and 0.7% solids by weight, produces a passing result in a Peugeot XUD11 Screener Engine Test.

For example, a multiple function dispersant viscosity index improver of embodiments of the present invention will produce results that are similar to those achieved by the graft polymer-containing blend labeled as Blend-2 in Table 1 of published application U.S. 2008/0293600 A1, incorporated herein by reference.

Peugeot DV4TD Medium Temperature Dispersivity Test

The capability of the multiple function dispersant viscosity index improver to control soot and viscosity increase may be demonstrated using the Peugeot DV4TD Medium Temperature Dispersivity Test ("DV4 Test"). The DV4 Test is a procedure for evaluating the effect of combustion soot on engine oil viscosity increase. The procedure simulates high-speed highway service in a diesel-powered passenger car using a fixture that comprises an engine dynamometer procedure stand with a Peugeot DV4 TD/L4 four-cylinder in-line, common rail diesel engine installed. The engine undergoes a ten hour run-in and is then operated continuously for 120 hours.

The lubricating oil is measured for kinematic viscosity at 100° C., soot content, and iron content at 24-hour intervals during the procedure. The final oil drain is used in conjunction with intermediate samples to interpolate the absolute viscosity at 6% soot. The absolute viscosity increase of the lubricating oil is then calculated by taking the absolute viscosity increase at 6% soot and subtracting the viscosity of the fresh oil. This value is then compared against an ACEA performance requirement value to determine whether the lubricating oil passed the DV4 Test. If the absolute viscosity increase of the lubricating oil (at 100° C., 6% soot) is less than or equivalent to the ACEA performance requirement value, the lubricating oil is deemed to have passed the DV4 Test. The ACEA performance requirement value for a given DV4 Test is determined from the test results of two reference oils, one having a very low viscosity increase at 100° C., 6% soot and one having a very high viscosity increase at 100° C., 6% soot. Both the absolute viscosity increase and the ACEA performance requirement are measured in $mm^2/s$.

Since the DV4 Test evaluates soot handling and viscosity control, the compositional variable of primary importance is the concentration of the "soot handling" functional group, the reaction product between the aromatic amine and the acylated polymer. The aromatic amine, and hence the "soot handling" functional group, is selected so as to be effective to provide a multiple function dispersant viscosity index improver that, when present in reasonable amounts in a base oil, produces a passing result in the DV4 Test. The amount of the "soot handling" functional group that is grafted to the polymer backbone, i.e. the concentration of the "soot handling" functional group, is preferably effective to provide a multiple function dispersant viscosity index improver that, when present in reasonable amounts in base oil, produces a passing result in the DV4 Test.

For example, the multiple function dispersant viscosity index improver, when present in base oil in an amount of about 0.05% solids by weight or below, produces a passing result in a DV4 Test. Alternatively, the multiple function dispersant viscosity index improver, when present in base oil in an amount of about 0.10% solids by weight or below, produces a passing result in a DV4 Test. Alternatively, the multiple function dispersant viscosity index improver, when present in base oil in an amount of about 0.15% solids by weight or below, produces a passing result in a DV4 Test. Alternatively, the multiple function dispersant viscosity index improver, when present in base oil in an amount of about 0.20% solids by weight or below, produces a passing result in a DV4 Test. Alternatively, the multiple function dispersant viscosity index improver, when present in base oil in an amount of about 0.25% solids by weight or below, produces a passing result in a DV4 Test. Alternatively, the multiple function dispersant viscosity index improver, when present in base oil in an amount of about 0.30% solids by weight or below, produces a passing result in a DV4 Test. Alternatively, the multiple function dispersant viscosity index improver, when present in base oil in an amount of about 0.35% solids by weight or below, produces a passing result in a DV4 Test. Alternatively, the multiple function dispersant viscosity index improver, when present in base oil in an amount of about 0.40% solids by weight or below, produces a passing result in a DV4 Test. Alternatively, the multiple function dispersant viscosity index improver, when present in base oil in an amount of about 0.45% solids by weight or below, produces a passing result in a DV4 Test. Alternatively, the multiple function dispersant viscosity index improver, when present in base oil in an amount of about 0.50% solids by weight or below, produces a passing result in a DV4 Test. Alternatively, the multiple function dispersant viscosity index improver, when present in base oil in an amount of about 0.55% solids by weight or below, produces a passing result in a DV4 Test. Alternatively, the multiple function dispersant viscosity index improver, when present in base oil in an amount of about 0.60% solids by weight or below, produces a passing result in a DV4 Test. Alternatively, the multiple function dispersant viscosity index improver, when present in base oil in an amount of about 0.65% solids by weight or below, produces a passing result in a DV4 Test. Alternatively, the multiple function dispersant viscosity index improver, when present in base oil in an amount of about 0.70% solids by weight or below, produces a passing result in a DV4 Test. Alternatively, the multiple function dispersant viscosity index improver, when present in base oil in an amount of about 0.80% solids by weight or below, produces a passing result in a DV4 Test. Alternatively, the multiple function dispersant viscosity index improver, when present in base oil in an amount of about 0.90% solids by weight or below, produces a passing result in a DV4 Test. Alternatively, the multiple function dispersant viscosity index improver, when present in base oil in an amount of about 1.0% solids by weight or below, produces a passing result in a DV4 Test. Alternatively, the multiple function dispersant viscosity index improver, when present in base oil in an amount of about 1.5% solids by weight or below, produces a passing result in a DV4 Test. Alternatively, the multiple function dispersant viscosity index improver, when present in base oil in an amount of about 2.0% solids by weight or below, produces a passing result in a DV4 Test. Alternatively, the multiple function dispersant viscosity index improver, when present in base oil in an amount of about 2.5% solids by weight or below, produces a passing result in a DV4 Test. Alternatively, the multiple function dispersant viscosity index improver, when present in base oil in an amount of about 3.0% solids by weight or below, produces a passing result in a DV4 Test. In one embodiment, the multiple function dispersant viscosity index improver, when present in base oil in an amount between 0.4 and 0.7% solids by weight, produces a passing result in a DV4 Test.

It can be seen that the described embodiments provide a unique and novel multiple function dispersant graft polymer that has a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims. All references mentioned in this description, including publications, patent applications, and patents, are incorporated by reference in their entirety. In addition, the materials, methods, and examples described are only illustrative and not intended to be limiting.

The invention claimed is:

1. A method of making a multiple function dispersant graft polymer comprising two different functional groups, each directly grafted to a polymer backbone having graftable sites, in which:

a first functional group comprises the reaction product of an acylating agent and a first amine, the first amine comprising an aromatic primary amine; and a second functional group comprises the reaction product of the acylating agent and a second amine, the second amine comprising an aliphatic primary amine;

wherein the multiple function dispersant graft polymer has at least about 5 moles of each of said functional groups per mole of polymer backbone, and wherein the first functional group provides the multiple function dispersant graft polymer with a soot handling performance attribute and the second functional group provides the multiple function dispersant graft polymer with a sludge and varnish control performance attribute, the method comprising:

melt-reacting a polymer backbone having graftable sites and an acylating agent having at least one point of olefinic unsaturation to form a graft polymer reaction product having acyl groups available for reaction; and reacting acyl groups of the graft polymer reaction product with a first amine comprising an aromatic primary amine to form first functional groups, and reacting acyl groups of the graft polymer reaction product with a second amine comprising an aliphatic primary amine to form second functional groups, wherein the only groups grafted to the polymer backbone are acylating agents or reaction products thereof.

2. The method of claim 1, wherein the multiple function dispersant graft polymer has a Rapid ADT response of at least about 8.

3. The method of claim 1, wherein the first functional group and the second functional group are present in the multiple function dispersant graft polymer in a molar ratio between 1:1.5 and 1.5:1.

4. The method of claim 1, wherein said second amine is selected from the group consisting of 2,2-dimethyl-1,3-dioxolane-4-methanamine; N-(3-aminopropyl)imidazole; N-(3-aminopropyl)-2-pyrrolidinone; 2-picolylamine, and combinations thereof.

5. The method of claim 1, wherein said first amine is selected from the group consisting of aniline; N,N-dimethyl-p-phenylenediamine; 1-naphthylamine; N-phenyl-p-phenylenediamine (also known as 4-aminodiphenylamine or ADPA); m-anisidine; 3-amino-4-methylpyridine; 4-nitroaniline; and combinations thereof.

6. The method of claim 1, wherein said acylating agents are selected from the group consisting of maleic acid, fumaric acid, maleic anhydride, and combinations thereof.

7. The method of claim 1, wherein said polymer backbone having graftable sites is selected from the group consisting of olefin polymers, olefin copolymers, polyesters, and styrene-butadiene copolymers.

8. The method of claim 1, wherein the first amine is 4-aminodiphenylamine and the second amine is N-(3-aminopropyl)imidazole.

9. The method of claim 1, wherein the first amine is reacted with acyl groups of the graft polymer reaction product in a solvent; and the second amine is reacted with acyl groups of the graft polymer reaction product in the solvent.

10. The method of claim 9, wherein the solvent has at least about 7% by weight aromatics.

11. The method of claim 1, wherein the first amine is melt-reacted with acyl groups of the graft polymer reaction product; and the second amine is reacted with acyl groups of the graft polymer reaction product in a solvent; or the first amine is with acyl groups of the graft polymer reaction product in the solvent; and the second amine is melt-reacted with acyl groups of the graft polymer reaction product.

12. The method of claim 11, wherein the solvent has at least about 7% by weight aromatics.

13. The method of claim 1, wherein the first amine is melt-reacted with acyl groups of the graft polymer reaction product; and the second amine is melt-reacted.

14. The method of claim 1, wherein the melt-reaction is reactive extrusion.

15. A method of making a multiple function dispersant graft polymer comprising a first functional group comprises the reaction product of an acylating agent and a first amine, the first amine comprising an aromatic primary amine; and a second functional group comprises the reaction product of the acylating agent and a second amine, the second amine comprising an aliphatic primary amine;

wherein the multiple function dispersant graft polymer has at least about 5 moles of each of said functional groups per mole of polymer backbone, and wherein the first functional group provides the multiple function dispersant graft polymer with a soot handling performance attribute and the second functional group provides the multiple function dispersant graft polymer with a sludge and varnish control performance attribute, the method comprising:

obtaining a graft polymer comprising a polymer backbone having acylating agents grafted thereto, the acylating agents being available for reaction;

reacting acylating agents of the graft polymer with a first amine to form first functional groups; and reacting acylating agents of the graft polymer with a second amine comprising an aliphatic primary amine to form second functional groups, wherein the reacting with the first amine, the reacting with the second amine, or both are performed via melt-reaction, wherein the only groups grafted to the polymer backbone are acylating agents or reaction products thereof.

16. The method of claim 15, wherein both the reacting with the first amine and the reacting with the second amine are performed via melt-reaction.

17. The method of claim 15, wherein said first amine is selected from the group consisting of aniline; N,N-dimethyl-p-phenylenediamine; 1-naphthylamine; N-phenyl-p-phenylenediamine (also known as 4-aminodiphenylamine or ADPA); m-anisidine; 3-amino-4-methylpyridine; 4-nitroaniline; and combinations thereof; and said second amine is selected from the group consisting of 2,2-dimethyl-1,3-dioxolane-4-methanamine; N-(3-aminopropyl)imidazole; N-(3-aminopropyl)-2-pyrrolidinone; 2-picolylamine, and combinations thereof.

18. The method of claim 15, wherein the first functional group and the second functional group are present in the multiple function dispersant graft polymer in a molar ratio between 1:1.5 and 1.5:1.

* * * * *